US011090796B1

(12) United States Patent
Stoddard

(10) Patent No.: US 11,090,796 B1
(45) Date of Patent: Aug. 17, 2021

(54) DROP NIPPLE TOOL

(71) Applicant: Jim Stoddard, Carlsbad, CA (US)

(72) Inventor: Jim Stoddard, Carlsbad, CA (US)

(73) Assignee: Jim Stoddard, Carlsbad, CA (US)

( * ) Notice: Subject to any disclaimer, the term of this patent is extended or adjusted under 35 U.S.C. 154(b) by 127 days.

(21) Appl. No.: 16/133,105

(22) Filed: Sep. 17, 2018

Related U.S. Application Data

(60) Provisional application No. 62/559,988, filed on Sep. 18, 2017.

(51) Int. Cl.

| | |
|---|---|
| ***B25G 1/00*** | (2006.01) |
| ***A62C 37/09*** | (2006.01) |
| ***B25G 1/04*** | (2006.01) |
| ***B25B 13/06*** | (2006.01) |
| ***B25B 23/16*** | (2006.01) |
| ***B25B 13/48*** | (2006.01) |

(52) U.S. Cl.
CPC ..... *B25G 1/005* (2013.01); *A62C 37/09* (2013.01); *B25B 13/06* (2013.01); *B25B 13/48* (2013.01); *B25B 23/16* (2013.01); *B25G 1/043* (2013.01)

(58) Field of Classification Search
CPC ..... B25G 1/005; B25G 1/043; A62C 37/09; B25B 13/06; B25B 13/48; B25B 23/16
See application file for complete search history.

(56) References Cited

U.S. PATENT DOCUMENTS 3,863,693 A * 2/1975 Carriker ..... B25B 15/02 81/177.6
4,085,633 A * 4/1978 Jackson ..... B25B 13/48 81/111
4,334,443 A * 6/1982 Pearson ..... B25B 13/48 81/55
5,879,112 A * 3/1999 Ivey ..... F16L 41/04 137/318
6,880,432 B2 * 4/2005 Hsieh ..... B25B 13/06 192/43.2
6,951,154 B2 * 10/2005 Hsien ..... B25B 13/06 81/58.4
7,775,141 B2 * 8/2010 Thompson ..... B25B 23/0021 81/63.1
7,975,576 B2 * 7/2011 Eggert ..... B25B 23/0035 81/177.85
2007/0062343 A1 * 3/2007 Dodson, Jr. ..... B25G 1/043 81/177.2
2010/0005932 A1 * 1/2010 Young ..... B25B 13/48 81/124.2
2020/0149637 A1 * 5/2020 Mok ..... F16L 33/24

OTHER PUBLICATIONS

Bighorn_Auction_Wrench_Kit (Year: 2016).*
Aaron Stickley, "How to Use a Basin Wrench", https://www.thespruce.com/how-to-use-a-basin-wrench-2718720, Jul. 19, 2017, 6 pages.
Universal Drop Nipple Wrench Usage Diagram with Universal Drop Nipple Wrench Kit Instructions, available as early as Sep. 18, 2017, 2 pages.

* cited by examiner

*Primary Examiner* — Hadi Shakeri
(74) *Attorney, Agent, or Firm* — Charles L. Thoeming

(57) ABSTRACT

A drop nipple wrench assembly can tighten and/or loosen a drop nipple of a fire sprinkler system. A drive handle of the wrench assembly can be folded along a guide shaft for storage. The drive handle can be extended generally perpendicular to the guide shaft to provide leverage for loosening and/or tightening the drop nipple.

16 Claims, 21 Drawing Sheets

Known Art

DROP NIPPLE TOOL

CROSS-REFERENCE

This application claims the priority benefit of U.S. Provisional Application No. 62/559,988, filed Sep. 18, 2017, the entirety of which is incorporated herein by reference.

BACKGROUND

Technical Field

This disclosure relates to tools for adjusting portions of fire sprinkler systems, such as tools for tightening and/or loosening a drop nipple.

Certain Related Art

Fire sprinkler systems are safety devices that spray water to inhibit combustion. The system can include one or more pipes and one or more sprinkler heads, such as upright or pendent sprinkler heads. Each of the sprinkler heads can be connected to one of the pipes via a drop nipple. The drop nipple can have a first end coupled to the pipe and a second end coupled to a reducer coupling, which is in turn coupled to the sprinkler head. The second end of the drop nipple can be generally vertically below the first end. When the sprinkler system is activated, such as during a fire, water is delivered to the sprinkler heads via the pipes, drop nipples, and reducer couplings.

SUMMARY OF CERTAIN FEATURES

Some sprinkler heads project below a ceiling, such as a drywall or tiled drop ceiling. This style of installation can be an economic way of mounting the sprinkler heads and can be effective in facilitating a broad spray area from the sprinkler heads. Some sprinkler heads are recessed at or above the ceiling. This style can of installation provide more streamlined look to a room and/or can protect the sprinkler heads from damage.

In some instances it can be desirable to convert a fire sprinkler system with sprinkler heads that project below a ceiling into a system in which the sprinkler heads are recessed at or above the ceiling. Because the drop nipple spans the distance between the sprinkler head and the distribution pipe, such a conversion process can include reducing the length of the drop nipple. For example, the conversion process can include, for each sprinkler head site: unthreading the drop nipple from the distribution pipe, cutting off a length of one end of the drop nipple, forming new threads on the end that had the portion removed, and threading the now shortened drop nipple into the distribution pipe. In some embodiments, the drop nipple and reducer coupling are removed and replaced as a unit. The process can include removing and/or installing the sprinkler head in the reducer coupling.

A problem with threading or unthreading the drop nipple from the distribution pipe is that the threaded connection between the drop nipple and the distribution pipe is typically a liquid-tight metal-to-metal connection, so requires the application of substantial torque. Moreover, because sprinkler heads are often located in a ceiling, a ladder is normally used to reach the drop nipple. However, ladders are somewhat unstable, especially as height increases. The instability can be exacerbated when a user on the ladder attempts to apply the aforementioned substantial torque to the drop nipple and/or reducer coupling. Although a pipe wrench could aid a user in applying sufficient torque, the space restraints of the ceiling space may not permit the use of such a large wrench.

Some smaller wrenches include a handle that provides a moment arm, such as a handle that extends generally perpendicularly to the rotational axis of the wrench. This can reduce the amount of force needed to be applied by the user. A problem with a handle that is generally perpendicular to the elongate wrench body is that the wrench assembly can be bulky. The bulky wrench assembly can be difficult and/or expensive to store and/or transport.

To reduce an overall size of the wrench assembly, the handle can be removable from the wrench body when the wrench assembly is not in use. A disadvantage of a removable handle is that the user needs to connect (e.g., screw on) the handle to the wrench body before using the wrench assembly and disassemble (e.g., unscrew) the handle from the wrench body for storage. The installing and uninstalling of the handle can be cumbersome. Another problem with the releasably attached handle is that the handle is of a fixed length. The length of the handle may not lower the required force sufficiently for some users, who may need a further extended bar. Handles with various lengths may need to be provided for a wrench assembly.

A further problem associated with loosening and/or tightening the reducer coupling and the drop nipple is that the reducer coupling can have varying external sizes. For example, the reducer coupling can have a generally hexagonal cross-section ("hex") with varying diameters. The wrench may need to have coupling sockets (e.g., hex sockets) of various sizes to accommodate the reducer couplings of various sizes. Some wrench body and the sockets can have holes. One or more screws can be placed across the holes of the socket and the wrench body when the holes are aligned.

A further problem in loosening and/or tightening the reducer coupling and the drop nipple is that the reducer coupling can have various internal sizes. For example, the reducer coupling can have a generally circular internal cross-section with internal threads of various sizes. The wrench assembly may need male threaded components of various sizes to accommodate the internal threads of various sizes. Some wrench assemblies can have guide shafts of different sizes slidably disposed within the elongate wrench body. The guide shafts of different sizes can include the male threaded component of different sizes. The user can change the guide shaft by removing one or more attachment screws connecting the guide shaft to a hand grip.

When using some drop nipple wrench assemblies, the user may seek to change the guide shaft and/or the socket based on the external and internal dimensions of the reducer coupling. The attachment features for some guide shafts and some sockets, such as described above, can require use of both hands of the user, and/or can be inconvenient and/or time-consuming.

Several embodiments of a drop nipple wrench assembly are disclosed herein that remedy one or more of the above-described problems, or other problems. According to some embodiments, the drop nipple wrench assembly can allow a user to adjust fire sprinkler systems (e.g., to make the sprinkler head flush to the finished ceiling or ceiling panels) by facilitating the loosening and/or tightening of a reducer coupling to a drop nipple. In some variants, the drop nipple wrench assembly can be compact in an overall size when in a storage configuration. In some variants, the wrench assembly can be conveniently converted to a deployed configuration. The wrench assembly can be easy to use. In some embodiments, the user can single-handedly convert the wrench assembly from a storage configuration to a deployed configuration, and/or single-handedly replace interchangeable components (e.g., a coupling socket and a male screw adapter). In some embodiments, the drop nipple wrench assembly can have safety features that promote user safety.

In various embodiments, a drop nipple wrench assembly can comprise a guide shaft, a sleeve slidably disposed over the guide shaft, a drive handle rotatably coupled to the sleeve, an interchangeable coupling socket, and an interchangeable male screw adapter. The interchangeable coupling socket or male screw adapter can be removably coupled to the guide shaft or the sleeve, respectively. The wrench assembly can have a storage configuration and a deployed configuration. In the storage configuration, a longitudinal axis of the drive handle can be generally parallel to a longitudinal axis of the guide shaft and/or sleeve. In the deployed configuration, the longitudinal axis of the drive handle can be generally perpendicular to the longitudinal axis of the guide shaft and/or sleeve. In some embodiments, the drive handle can be locked in the storage configuration until the coupling socket engages with the sleeve and/or a reducer coupling. In some embodiments, the drive handle can be locked in the deployed configuration as long as the coupling socket engages with the sleeve and/or a reducer coupling. In some variants, the coupling of the sleeve and the coupling socket comprises a ratcheting assembly. In some implementations, the wrench assembly includes a swivel grip on guide shaft. The swivel grip can swivel (e.g., relative to the sleeve) when the wrench is engaged with the reducer coupling, such as with an outer barrel and/or a hex connection of the reducer coupling. In some embodiments, the wrench includes a ratcheting assembly for the outer barrel and/or the coupling socket. The wrench can be made of a metal, such as tempered aluminum.

BRIEF DESCRIPTION OF THE DRAWINGS

Various embodiments are depicted in the accompanying drawings for illustrative purposes, and should in no way be interpreted as limiting the scope of the embodiments. In addition, various features of different disclosed embodiments can be combined to form additional embodiments, which are part of this disclosure. In the drawings, similar elements have reference numerals with the same last two digits.

DETAILED DESCRIPTION OF CERTAIN EMBODIMENTS

Although certain embodiments and examples are described below, this disclosure extends beyond the specifically disclosed embodiments and/or uses and obvious modifications and equivalents thereof. Thus, it is intended that the scope of this disclosure should not be limited by any particular embodiments described herein or depicted in the figures.

Fire Sprinkler System Overview

Figure 1:
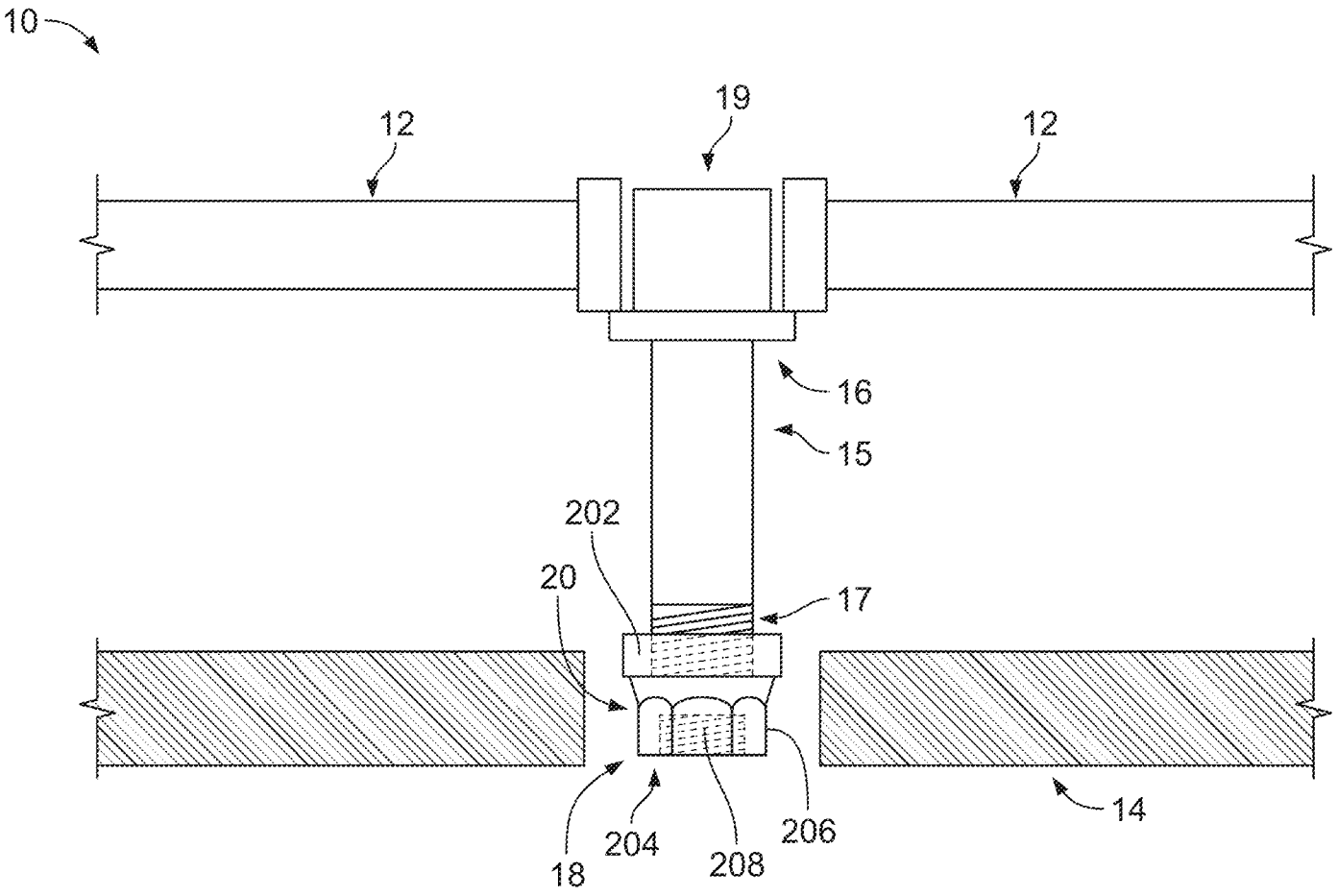
FIG. 1 schematically illustrates an installed fire sprinkler assembly with a sprinkler head removed for purposes of presentation.

FIG. 1 illustrates a portion of an installed fire sprinkler system 10. The system 10 can comprise one or more distribution pipes 12, which can include main lines, branch lines, or other pipes that supply fire suppression water. The distribution pipes 12 can extend generally horizontally. The distribution pipes 12 can be located between a structural ceiling of a building structure and a finished ceiling 14 (e.g., drop ceiling tiles, drywall, etc.). The distribution pipes 12 can include an inlet that is connected to a water source.

At or near the location of a sprinkler head, a drop nipple 15 can be connected to one of the distribution pipes 12. The drop nipple 15 can have an elongate body. The elongate body can have a fluid pathway generally parallel to the elongate body. The drop nipple 15 can have a drop nipple inlet 16 coupled (e.g., threaded) to a portion of the distribution pipe 12. For example, as shown, the drop nipple 15 can be coupled with a threaded fitting (e.g., a tee, elbow, or otherwise) in the distribution pipes 12. The drop nipple 15 can have a drop nipple outlet 17. In some embodiments, the outlet 17 is generally vertically below the inlet 16. In some embodiments, such as shown in FIG. 1, the drop nipple outlet 17 can be at or near an opening 18 in the finished ceiling 14.

The drop nipple outlet 17 can be coupled (e.g., threaded) to a reducer coupling 20. The combination of the reducer coupling 20 and the drop nipple 15 can be called a "drop assembly." The reducer coupling 20 can have a drop nipple coupling feature 202 (e.g., threads) and a sprinkler head coupling feature 204. In some embodiments, the sprinkler head coupling feature 204 can include a female threaded component 208 with internal threads. The sprinkler head coupling feature 204 can couple the reducer coupling 20 to the sprinkler head. In various embodiments, the reducer coupling includes a mechanical connection feature, such as an external hex 206. This can enable a wrench to be applied to the reducer coupling, such as during mating with the drop nipple 15 and/or the sprinkler head. In various embodiments, the system 10 can provide water to the sprinkler head (e.g., an upright and/or pendent sprinkler head) via the distribution pipes 12, drop nipple 15, and reducer coupling 20.

Certain Embodiments of a Drop Nipple Wrench Assembly

FIGS. 2-7 illustrate embodiments of a drop nipple wrench assembly 100, and components thereof. The wrench assembly 100 can be configured for removing (e.g., loosening) the drop assembly from and/or installing (e.g., tightening) the drop assembly into the distribution pipes 12.

As illustrated, the wrench assembly 100 can comprise a guide shaft 110. The guide shaft 110 can have an elongate body between an adapter end 112 and a hand-grip end 114. In some embodiments, at least the elongate body of the guide shaft 110 can be solid to provide rigidity. For example, as shown, the guide shaft 110 can comprise a solid bar of material, such as metal.

The adapter end 112 of the guide shaft 110 can comprise coupling features for a male threaded component adapter 120. The male threaded component adapter 120 can have a male threaded portion 122 and a guide shaft coupling portion 124. When the wrench 100 is engaged with the reducer coupling 20, the male threaded portion 122 can be configured to fit into the female threaded component 208 of the reducer coupling 20.

Figure 3A:
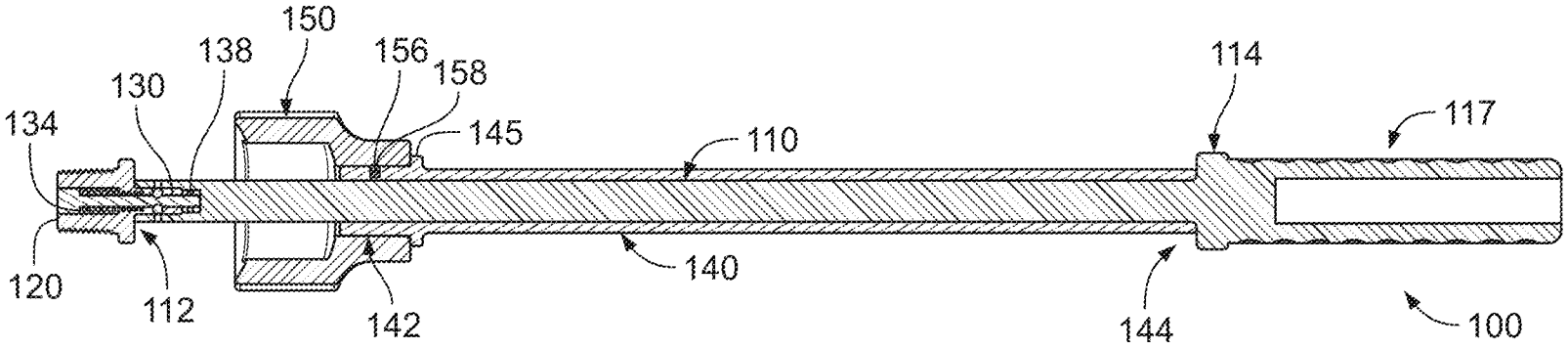
FIG. 3A illustrates a cross-section of the drop nipple wrench assembly of FIG. 2 along the line 3A-3A.
Figure 3B:
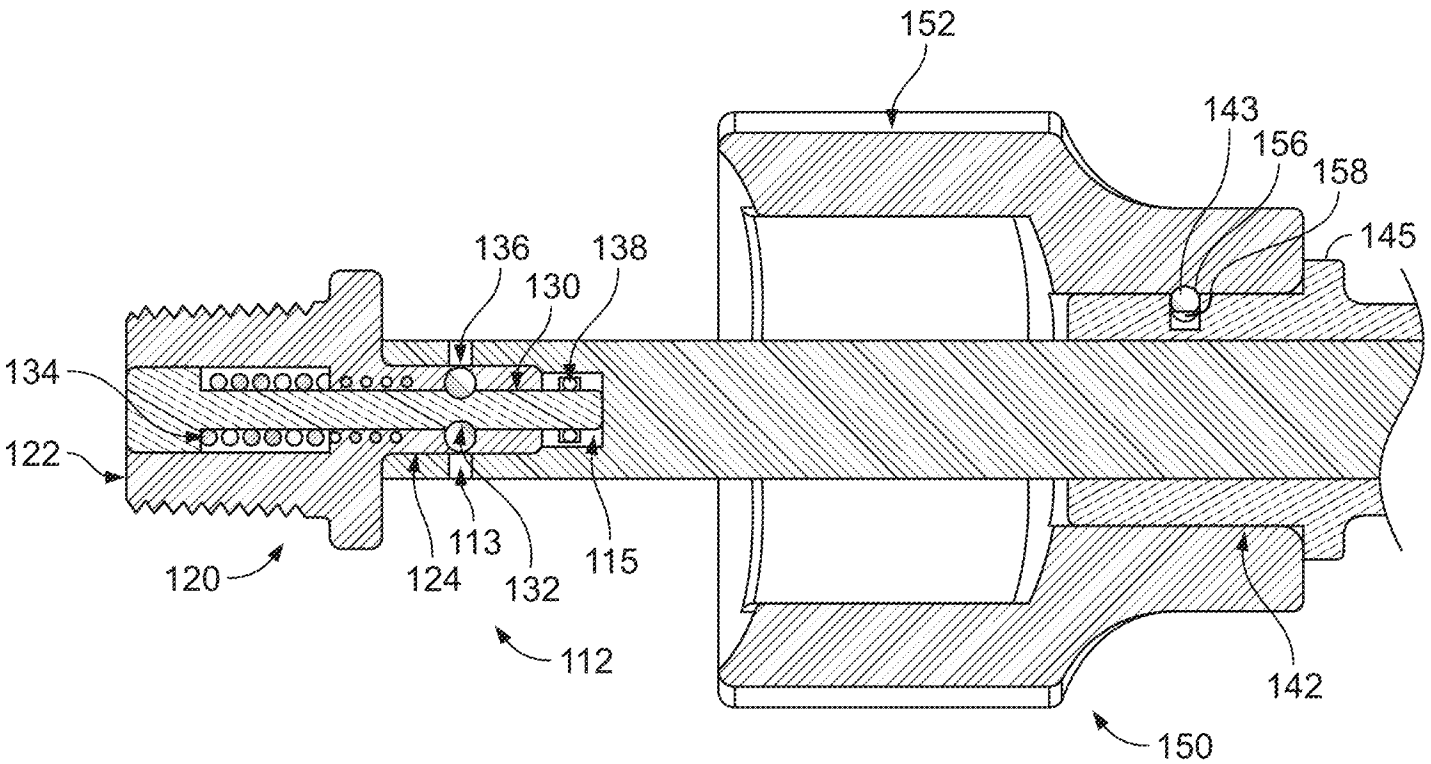
FIG. 3B illustrates a detailed view of various locking mechanisms at an adapter end of a drive draft of the drop nipple wrench assembly of FIG. 3A.

The guide shaft coupling portion 124 of the adapter 120 can be sized to engage with (e.g., slidably fit within) the adapter end 112. The coupling portion 124 can be received in a channel 115 of the guide shaft 110. In various embodiments, the coupling portion 124 can be removably connected to the guide shaft 110. For example, as shown in FIGS. 3A and 3B, the removable coupling features can comprise a detent feature. The detent arrangement can include a spring-biased locking pin 130 with an annular groove 132 and one or more (e.g., two) locking members 136 (e.g., spherical balls) on the guide shaft coupling portion 124 of the adapter 120. A wall of the guide shaft coupling portion 124 of the adapter 120 can have one or more recesses or apertures for accommodating and constraining the one or more balls 136. The ball 136 can have a loose fit within the recess or aperture. At least a portion of the ball 136 can protrude from an internal surface and/or an external surface of the wall of the guide shaft coupling portion 124. The locking pin 130 can have a shaft sized to be slidably disposed within a lumen of the adapter 120. The shaft of the locking pin 130 can slide within the lumen. An internal diameter of the lumen of the guide shaft coupling portion 124 can be configured to allow the shaft of the locking pin 130 to push the balls 136 radially outward. Protruding portions of the balls 136 can engage side openings 113 on the guide shaft 110 near the adapter end 112. The balls 136 can be biased, such as with springs that bias the balls 136 radially outward or inward.

In some embodiments, such as shown in FIG. 3B, the detent arrangement can include a retention ring 138. The retention ring 138 can have an internal dimension (e.g., diameter) configured to engage the shaft (e.g., an annular groove on the shaft) of the locking pin 130. The retention ring 138 can have an external dimension (e.g., diameter) configured to engage (e.g., with a friction fit) an internal side wall of a portion of the channel 115.

In some embodiments, such as shown in FIG. 3B, the detent arrangement can include a spring 134 (e.g., a compression spring). The spring 134 can extend between a flange of the locking pin 130 and an end surface of the male threaded portion 122 of the adapter 120. When the adaptor 120 is engaged with the guide shaft 110, the coupling portion 124 can be inverted into the channel 115. The shaft of the locking pin 130 can be moved against the bias of the spring 134 to the position in which the balls 136 are received in the groove 132 in the guide shaft 110. The locking pin 130 can be released and the bias of the spring 134 can move the locking pin 130, thereby displacing the balls 136 out of the groove 132. The balls 136 can be partially received in the recesses or openings in the openings 113 on the guide shaft 110.

In some variants, to remove the adapter 120 from the guide shaft 110, one or more push buttons (not shown) extending outward from the side openings 113 of the guide shaft 110 can be pushed radially inward. The push buttons can in turn push the balls 136 radially inward to disengage the balls 136 from the side openings 113. The compressed spring 134 can provide a force to push the locking pin 130 away from the guide shaft 110 to allow the adapter 120 to be removed from the guide shaft 110.

In some embodiments, the drop nipple wrench assembly 100 can comprise a plurality of male threaded component adapters 120. The plurality of male threaded component adapters 120 can have a guide shaft coupling portion 124 of substantially the same size and a male threaded portion 122 of different sizes (e.g., having external diameter of about ½", about ¾", or other sizes). A user can remove a first adapter 120 and install a second adapter 120 by pushing the locking pin 130 into the channel 115. Replacing the male threaded component adapter 120 can be easier and/or less time consuming than replacing the guide shaft 110. In some embodiments, the user is able to replace the adapter 120 with a single hand.

Figure 4:
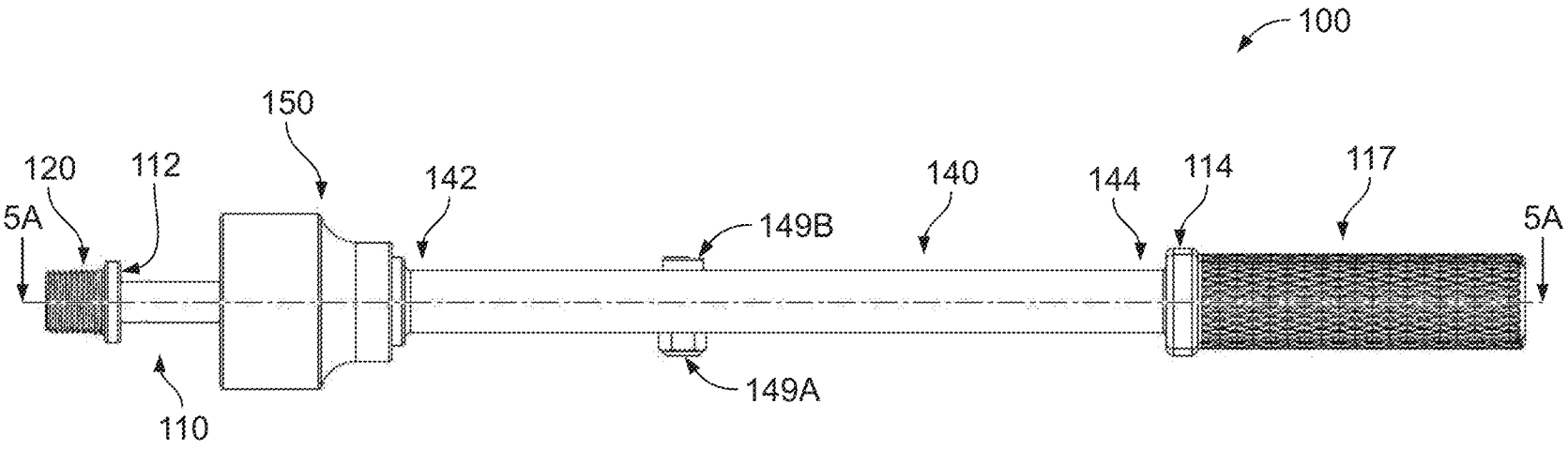
FIG. 4 schematically illustrates a bottom view of the drop nipple wrench assembly of FIG. 2.
Figure 5A:
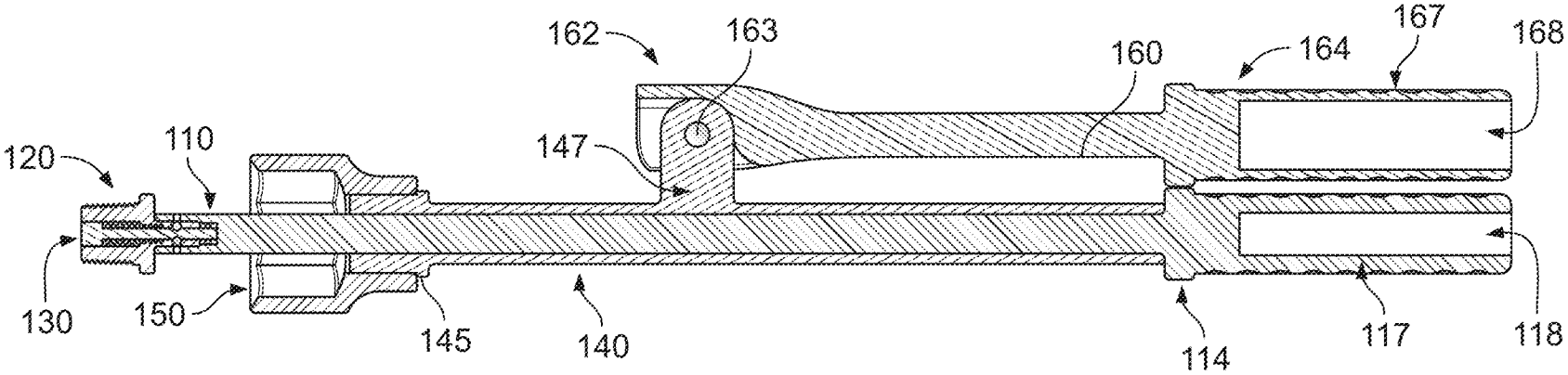
FIG. 5A schematically illustrates a cross-section of the drop nipple wrench assembly of FIG. 4 along the line 5A-5A.

As shown in FIGS. 3A, 4, and 5A, the drop nipple wrench assembly 100 comprises a sleeve 140. The sleeve 140 can be slidably disposed (e.g., with a loose fit) over the guide shaft 110. The sleeve 140 can have an elongate body between a first end 142 and a second end 144. The elongate body can have a through-lumen extending from the first end 142 to the second end 144.

Figure 5B:
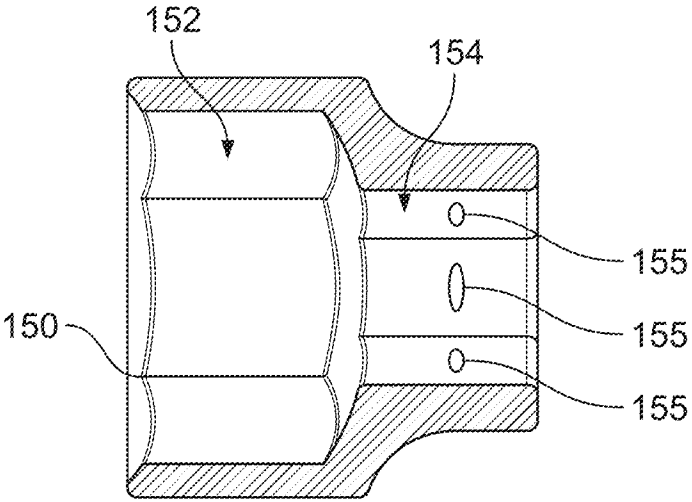
FIG. 5B schematically illustrates a cross-section of a coupling socket of the drop nipple wrench assembly of FIG. 3A FIGS. 6A and 6B schematically illustrate cross-sections of the drop nipple wrench assembly of FIG. 2 along the lines 6A-6A and 6B-6B.
Figure 6A:
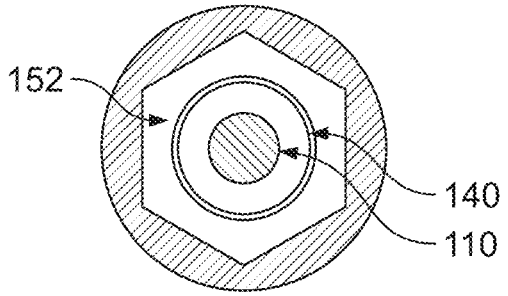
Figure 6B:
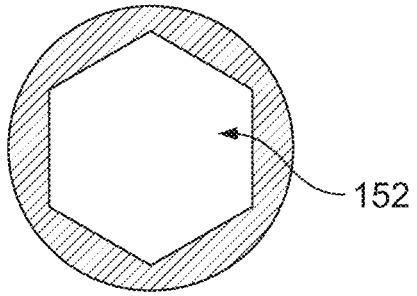

The first end 142 of the sleeve 140 can be configured to couple (e.g., removably) to a coupling socket 150. As shown in FIG. 5B, the coupling socket 150 can have a reducer coupling portion 152 and a sleeve coupling portion 154. A through-lumen can extend through the reducer coupling portion 152 and the sleeve coupling portion 154. The through-lumen can slidably accommodate the sleeve 140 and the guide shaft 110. When used to loosen and/or tighten a reducer coupling from a fire sprinkler assembly, the reducer coupling portion 152 of the coupling socket 150 can be configured to mate with an external mating feature (e.g., a hex) of the reducer coupling. In some embodiments, such as shown in FIGS. 6A and 6B, the reducer coupling portion 152 can comprise a hex socket.

In some embodiments, such as shown in FIGS. 3B and 5B, removable coupling features between the first end 142 of the sleeve 140 and the coupling socket 150 can comprise a ball detent arrangement. The ball detent arrangement can include mating of one or more recesses 155 of the coupling socket 150 and a spring-biased ball 156 (e.g., a spherical ball) on the sleeve 140 near the first end 142. As shown in FIG. 5B, the recesses 155 can be located on an internal wall of the sleeve coupling portion 154 of the coupling socket 150. Having a plurality of recesses 155 on the coupling socket 150 can allow more efficient coupling of one of the recesses 155 and the ball 156 than having one recess 155. An outer wall of the sleeve 140 can have a channel 143 near the first end 142. The channel 143 can have an internal dimension (e.g., diameter) configured to accommodate and constrain the ball 156. The channel 143 can have a depth configured to accommodate a spring 158 (e.g., a compression spring). The spring 158 can be configured to bias the ball 156 radially outward such that at least a portion of the ball 156 can protrude from an opening of the channel 143 on the outer wall of the sleeve 140.

The coupling socket 150 can be configured to slide over the adapter end 112 of the guide shaft 110 and/or the sleeve 140. For example, with the adapter 120 removed, the coupling socket 150 can slide onto and over portions of the adapter end 112 and sleeve 140 from the left side of FIG. 3B and into the position shown in FIG. 3B. In certain embodiments, during engagement of the couple socket 150 onto the sleeve 140, the ball 156 can initially be pushed radially inward by the internal wall of the sleeve coupling portion 154 of the coupling 150. The spring 158 can be compressed by the ball 156. When one of the recesses 155 align with the ball 156, the compressed spring 158 can push the ball 156 radially outward into the recess 155. In some embodiments, the recess 155 and the ball 156 are aligned when the coupling socket 150 makes contact with a shoulder 145 of the sleeve 140. In some embodiments, a user needs to rotate the coupling socket 150 about a longitudinal axis of the sleeve 140 until the ball 156 engages one of the recesses 155. A physical interference between the ball 156 and the recess 155 can lock the coupling socket 150 onto the sleeve 140.

To release the coupling socket 150 from the sleeve 140, a user can apply a force greater than the friction between the ball 156 and the recess 155. For example, the user can pull the coupling socket 150 to the left in FIG. 3. The user's force can push the ball 156 radially inward against the spring 158 until the ball 156 clears the recess 155.

In some variants, the removable coupling features between the first end 142 of the sleeve 140 and the coupling socket 150 can comprise a ratcheting assembly. The ratcheting assembly can allow the coupling socket 150 to move relative to the sleeve 140 in one direction and prohibit movements of the coupling socket 150 relative to the sleeve 140 in an opposite direction.

In some embodiments, the drop nipple wrench assembly 100 can comprise a plurality of interchangeable coupling sockets 150. The plurality of coupling sockets 150 can have a sleeve coupling portion 154 of substantially the same size and a reducer coupling portion 152 of different sizes (e.g., having internal hex diameter of about 1 7/16", about 1 9/16", or other sizes). Replacing the coupling socket 150 with the ball detent arrangement described herein can be easier and/or less time consuming than replacing a coupling socket that is coupled to the sleeve 140 with a screw or locking pin. In some embodiments, the user is able to replace the coupling socket 150 with a single hand. Being able to change the coupling socket 150 can be convenient, since the same wrench assembly 100 can be used for multiple sprinkler system sizes.

Figure 2:
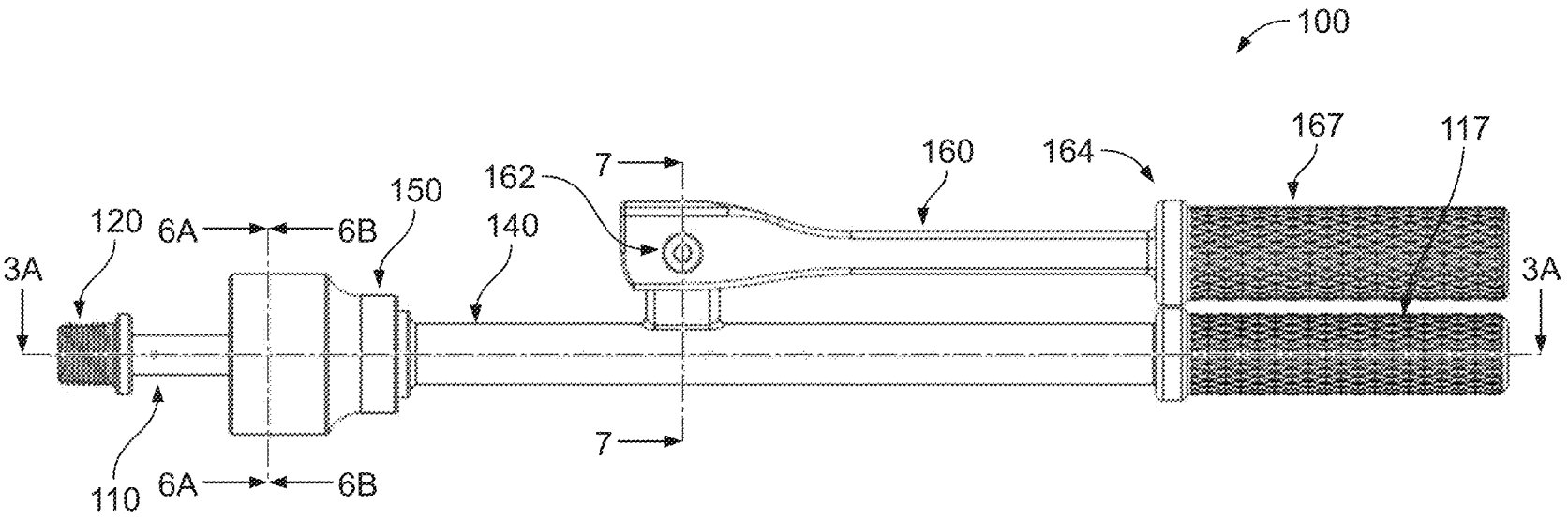
FIG. 2 illustrates a side view of an example drop nipple wrench assembly.
Figure 7:
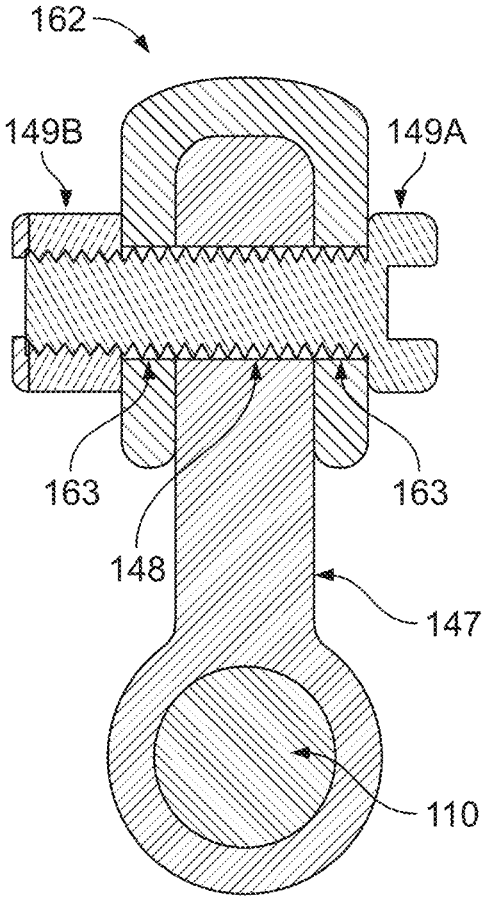
FIG. 7 schematically illustrates a cross-section of the drop nipple wrench assembly of FIG. 2 along the line 7-7.

As shown in FIGS. 2, 5A and 7, the elongate body of the sleeve 140 can comprise a side arm 147. The side arm 147 can be located anywhere along the elongate body. For example, the side arm 147 can be located about midway between the first and second ends 142, 144. The side arm 147 can comprise a hinge for the drive handle 160. The drive handle 160 can have a hinge end 162, a hand-grip end 164, and an elongate body between the hinge and hand-grip ends 162, 164. In some embodiments, at least the elongate body of the drive handle 160 can be solid. As shown in FIG. 7, the hinge end 162 of the drive handle 160 can comprise one or more pin holes 163. When aligned with a pin channel 148 on the side arm 147, a nut and bolt assembly 149A, 149B can fasten the hinge end 162 of the drive handle 160 to the side arm 147. In some variants, the hinged end 162 and the side arm 147 can be fastened by a locking pin engaged with the pin holes 148, 163. The drive handle 160 can be rotatable about the side arm 147.

The hand-grip end 114 of the guide shaft 110 and the hand-grip end 164 of the drive handle 160 can each comprise a handle portion 117, 167. In some embodiments, an outer surface of the handle portions 117, 167 can be knurled to improve traction of a user's hand on the hand-grip portions 117, 167. In some implementations, one or both of the handle portions 117, 167 can have a recess 118, 168. The recess 118, 168 can reduce an overall weight of the wrench assembly and/or be configured to receive an extension bar. The extension bar can increase a moment arm applied to the sleeve. This can increase the amount of force a user can apply when using the wrench to install or remove a drop assembly. In some embodiments, the sleeve 140 and the coupling socket 150 are configured to rotate relative to the adapter 120 and the guide shaft 110.

The drop nipple wrench assembly 100 can have a storage configuration and a deployed configuration. In the storage configuration, a longitudinal axis of the drive handle 160 can be generally parallel to a longitudinal axis of the guide shaft 110 and/or sleeve 140. In the deployed configuration, the longitudinal axis of the drive handle 160 can be generally perpendicular to the longitudinal axis of the guide shaft 110 and/or sleeve 140. In the storage configuration, the wrench assembly 100 can have a compact profile for storage and/or transportation (e.g., in a slender container box). In the deployed configuration, the user can grasp the handle portion 117 with one hand and the handle portion 167 (or the extension bar) with the other hand. The hand on the handle portion 117 can stabilize the guide shaft 110 and/or the adapter 120. The hand holding the handle portion 167 (or the extension bar) can push or pull on the handle portion 167 to create a torque to turn the sleeve 140 and the coupling socket 150 relative to the guide shaft 110. In some embodiments, the drive handle 160 can be locked in the storage configuration until the coupling socket 150 engages with the sleeve 140 and/or a reducer coupling. In some embodiments, the drive handle 160 can be locked into the deployed configuration when the coupling socket 150 engages with the sleeve 140 and/or a reducer coupling. The locking features can promote user safety by inhibiting or preventing the drive handle 160 from rotating about the side arm 147 by accident and/or when misused by a user.

One or more components of the wrench assembly 100, such as the guide shaft 110, the sleeve 140, the drive handle 160, and/or the coupling socket 150, can comprise a rigid material (e.g., metal, stainless steel, aluminum, aluminum alloy, tempered aluminum, or others). Method of Use of Certain Embodiments of a Drop Nipple Wrench Assembly To use embodiments of the drop nipple wrench assembly, such as the wrench assembly 100 described above, a user can select and install the male threaded component adapter 120 and coupling socket 150 onto the guide shaft 110 and the sleeve 140, respectively. The drive handle 160 can be rotated from the storage configuration to the deployed configuration. The sleeve 140 and the coupling socket 150 can be positioned near or moved toward the handle portion 117 so that the adapter 120 extends beyond the coupling socket 150.

The user can engage (e.g., threadably connect) the male threaded portion 122 of the adapter 120 onto a reducer coupling that is to be loosened from a fire sprinkler system. The mating of the male threaded portion 122 of the adapter 120 and the reducer coupling 20 can improve alignment of the coupling socket 150 with the outer perimeter (e.g., the hex) of the reducer coupling 20.

The user can slide the sleeve 140 and the coupling socket 150 (e.g., by holding on the handle portion 167 of the drive handle 160) relative to and/or along the guide shaft 110, such as upward toward the adapter 120. The reducer coupling portion 152 of the coupling socket 150 can receive and/or engage with the reducer coupling 20 (e.g., the hex of the reducer coupling).

With one hand holding the handle portion 117 to stabilize the guide shaft 110 relative to the reducer coupling 20, the user's other hand can push or pull on the handle portion 167 (or the extension bar) to turn the coupling socket 150 clockwise or counter-clockwise to loosen the reducer coupling.

In some embodiments, the drop nipple 15 and the reducer coupling 20 can be loosened from the distribution pipes as a single unit. In some embodiments, upon loosening and removal of the reducer coupling 20 from the drop nipple 15, the drop nipple 15 can be unscrewed (e.g., manually) from the distribution pipes 12. A special tool may not be necessary for removing the drop nipple 15 from the distribution pipes 12 because the torqued connection between the drop nipple 15 and the distribution pipes 12 is typically less than the torqued connection between the drop nipple 15 and the reducer coupling 20. For example, the torque connection between the drop nipple 15 and the reducer coupling 20 can be applied with a power tool and the torque connection between the drop nipple 15 and the distribution pipe 12 can be applied manually. The wrench assembly 100 described herein can remove the reducer coupling 20 from the drop nipple 15 when the drop nipple 15 is fixedly attached to the distribution pipes 12 so that additional stabilizing features, such as a bench vice, is not required.

In some implementations, similar methods can be used with the wrench assembly embodiments described herein to tighten a reducer coupling 20 onto a drop nipple 15. The drive handle 160 (or the extension bar) can mechanically torque the reducer coupling 20 relative to the drop nipple 15 to fasten the reducer coupling 20 to the drop nipple 15.

Further Examples of a Drop Nipple Wrench Assembly

FIGS. 8A-11E illustrate embodiments of a drop nipple wrench assembly 300, and components thereof. The assembly 300 and components thereof can have any of features of the assembly 100 and components thereof. Features of the assembly 300 can be incorporated into the assembly 100 and features of the assembly 100 can be incorporated into the assembly 300. The wrench assembly 300 can be configured for removing (e.g., loosening) the drop assembly from and/or installing (e.g., tightening) the drop assembly into the distribution pipes 12.

The assembly 300 can include a guide shaft 310 slidably received (e.g., with a loose fit) in a sleeve 340. The guide shaft 310 can have an elongate body between an adapter end 312 and a handle end 314. In some embodiments, at least the elongate body of the guide shaft 310 can be solid to provide rigidity. For example, as shown, the guide shaft 310 can comprise a solid bar of material, such as metal. The adapter end 312 of the guide shaft 310 can comprise coupling features (e.g., releasably coupling features) for a male threaded component adapter 320. The hand-grip end 314 can be coupled to a handle 317. The sleeve 340 can have an elongate body between a first end 342 and a second end 344. The elongate body of the sleeve 340 can have a through-lumen extending from the first end 342 to the second end 344 to receive the guide shaft 310. The first end 342 of the sleeve 340 can be configured to couple (e.g., removably) to a coupling socket 350. A drive handle 360 can be rotationally pivoted at a pivot ring 347 attached to the sleeve 340.

Figure 8A:
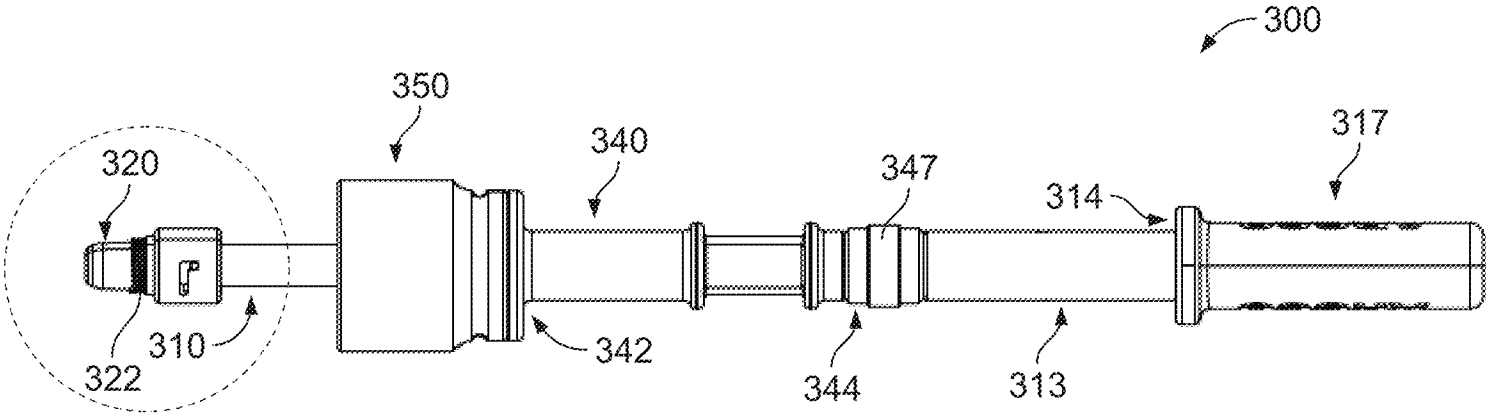
FIG. 8A illustrates a top view of another example drop nipple wrench assembly.
Figure 8B:
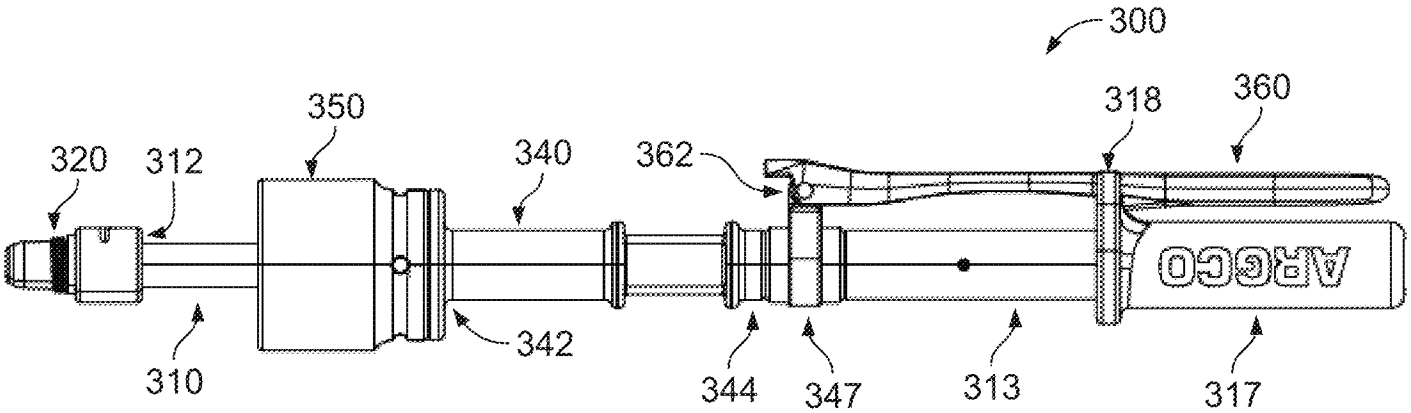
FIG. 8B illustrates a side view of the drop nipple wrench assembly of FIG. 8A.

FIGS. 8A and 8B illustrate the assembly 300 in an undeployed configuration. The sleeve 340 and the coupling socket 350 are positioned near or toward the handle portion 317 so that the adapter 320 extends beyond the coupling socket 350. The second end 344 of the sleeve 340 can be separated from the handle 317 by a spacer tube 313. The drive handle 360 can be in a stowed position or storage configuration (e.g., being generally parallel to the handle 317). The drive handle 360 can be locked in the stowed position with a ridge 361 (see FIGS. 9A-9B) on the drive handle 360 engaging a protrusion 318 on the handle 317. The protrusion 318 can include a groove configured to conform to the shape of a handle-facing side of the drive handle 360. As illustrated, in some embodiments, in the undeployed position, the drive handle 360 can be positioned generally parallel to the handle 317.

Figure 9A:
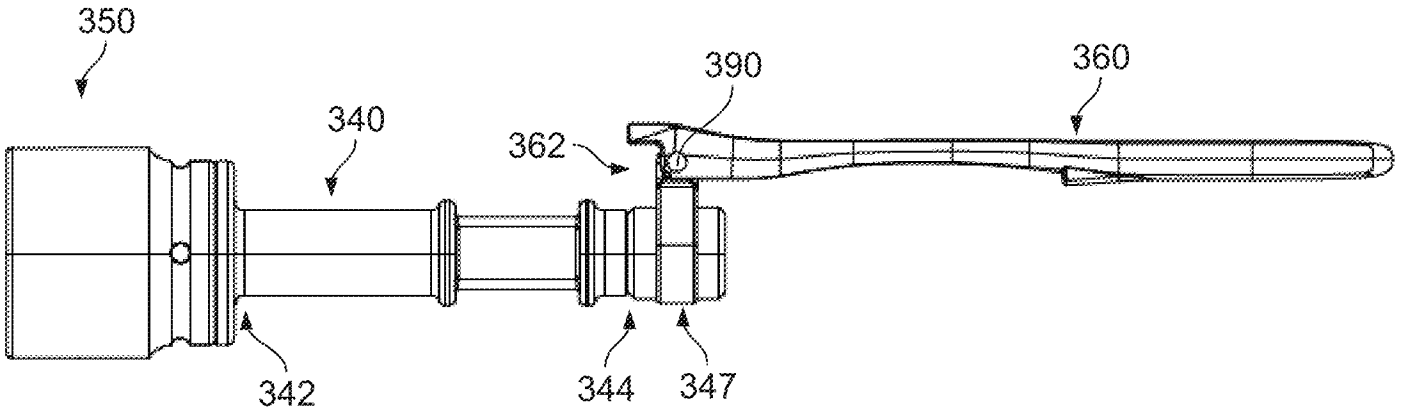
FIG. 9A illustrates a side view of a sleeve subassembly of the drop nipple wrench assembly of FIG. 8A.
Figure 9B:
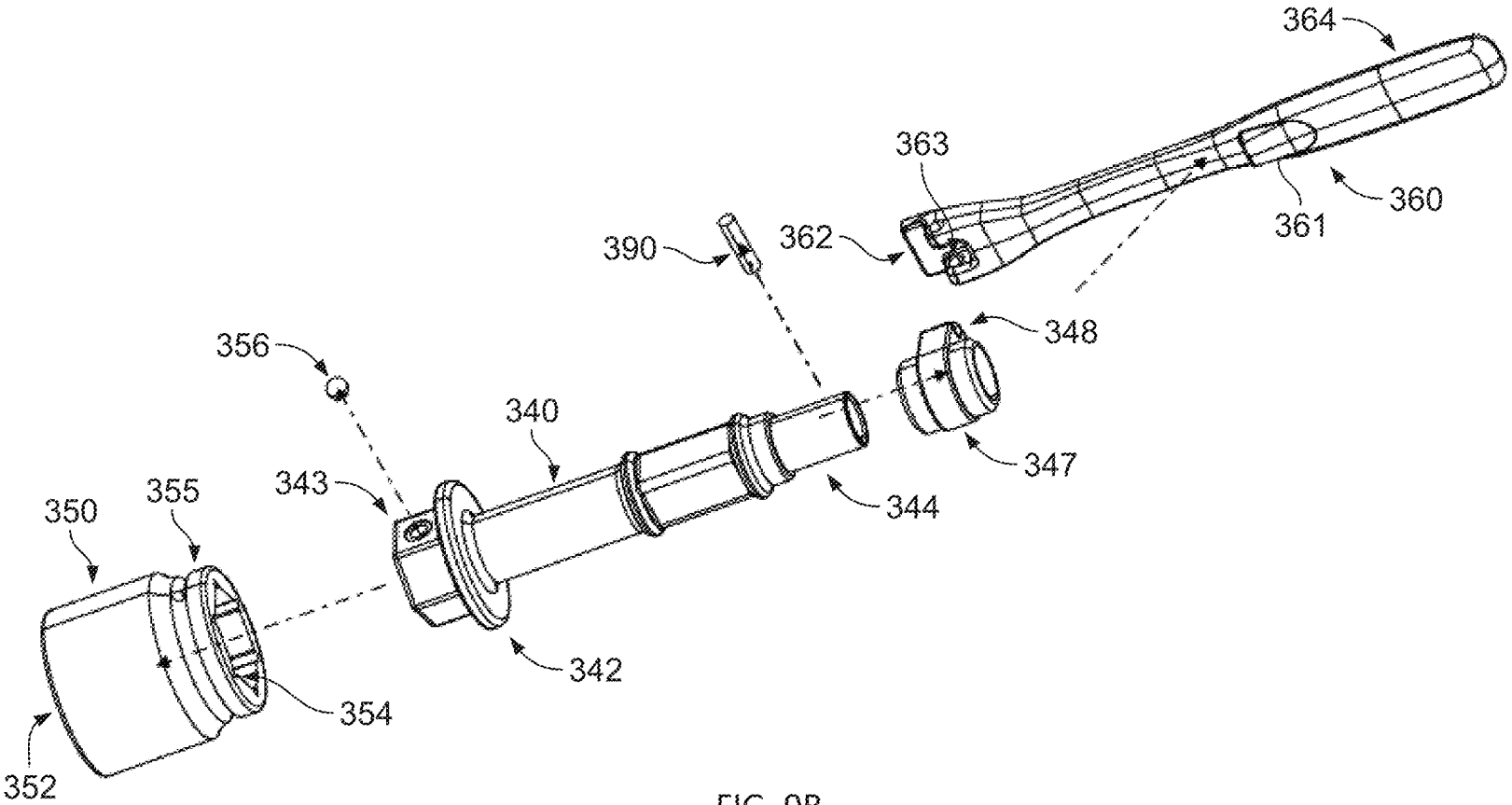
FIG. 9B illustrates an exploded view of the sleeve subassembly of FIG. 9A.

As shown in FIGS. 9A and 9B, the coupling socket 350 can have a reducer coupling portion 352 and a sleeve coupling portion 354. A through-lumen can extend through the reducer coupling portion 352 and the sleeve coupling portion 354. The through-lumen can slidably accommodate the sleeve 340 and the guide shaft 310. When used to loosen and/or tighten a reducer coupling from a fire sprinkler assembly, the reducer coupling portion 352 of the coupling socket 350 can be configured to mate with an external mating feature (e.g., a hex) of the reducer coupling. In some embodiments, such as shown in FIGS. 11A-11E, the reducer coupling portion 352 can comprise a hex socket. The hex socket can have various dimensions, such as different lengths across flats, D1, D2, D3, D4, D5, respectively, with D1 being the smallest dimension and D5 being the largest dimension. In some embodiments, the length across flats of the hex socket can be about 30.75 mm, about 33.00 mm, about 36.50 mm, about 37.75 mm, about 40.50 mm, or any ranges between such values. As shown in FIGS. 11A-11E, the sleeve coupling portion 354 can have substantially the same outer dimension when the reducer coupling portion 352 can vary in size as described above.

As shown in FIG. 9*b*, removable coupling features between the first end 342 of the sleeve 340 and sleeve coupling portion 354 of the coupling socket 350 can comprise a ball detent arrangement. The ball detent arrangement can include mating of a recess or opening 355 on the sleeve coupling portion 354 of the coupling socket 350 and a spring-biased ball 356 (e.g., a spherical ball) on the sleeve 340 near the first end 342. An outer wall of the sleeve 140 can have a recess 343 near the first end 342. The recess 343 can have an internal dimension (e.g., diameter) configured to accommodate at least partially and constrain the ball 356.

The recess 343 can have a depth configured to accommodate a spring, such as the spring shown in FIG. 3A (e.g., a compression spring). The spring can be configured to bias the ball 356 radially outward such that at least a portion of the ball 356 can protrude from the recess 343 on the outer wall of the sleeve 340. In some embodiments, such as shown in FIG. 9B, the first end 342 of the sleeve 340 can include a hex shape configured to be slidably received by the hex socket of the coupling socket 350. The engagement of the hex shape of the first end 342 of the sleeve 340 and the hex coupling socket 350 can allow rotation of the drive handle 360 (e.g., by a user pushing on a side of the handle 360) about the longitudinal axis of the coupling socket 350 to be translated to rotation of the coupling socket 350 about its longitudinal axis. Rotation of the drive handle 360 about the longitudinal axis of the coupling socket 350 can loosen the reducer coupling coupled with the coupling socket 350 from the distribution pipes, which can facilitate removal of the reducer coupling and/or can improve user-friendliness of the wrench assembly 300. In some embodiments, the user can grasp or stabilize the handle 317 while rotating the drive handle 360 about the longitudinal axis of the coupling socket 350. In some embodiments, the handle 360 is configured to rotate relative to the handle 317, such as about a longitudinal axis of the assembly 300.

To release the coupling socket 350 from the sleeve 340, the user can apply a force greater than the friction between the ball 356 and the opening 355. For example, the user can pull the coupling socket 350 forward or to the left in FIG. 9A. The user's force can push the ball 356 radially inward against the spring until the ball 356 clears the opening 355. In some implementations, the user can releasably couple any of the interchangeable coupling sockets 350 in FIGS. 11A-11E or any other suitable coupling sockets.

As shown in FIG. 9B, the pivot ring 347 can be coupled (such as with a press fit or otherwise fixedly attached) near the second end 344 of the sleeve 340. In some embodiments, the pivot ring 347 can be located anywhere along the sleeve 340. The pivot ring 347 can be coupled to the drive handle 360. For example, the pivot ring 347 can comprise a pin hole 348 for receipt of a pin that couples the pivot ring 347 to the drive handle 360. The drive handle 360 can have a hinge end 362, a hand-grip end 364, and an elongate body between the hinge and hand-grip ends 362, 364. The hinge end 362 of the drive handle 360 can comprise a pin hole 363. When the pin hole 363 and the pin hole 348 of the pivot ring 347 are aligned, the hinged end 362 of the drive handle 360 and the pivot ring 347 can be fastened by a locking pin 390. The drive handle 160 can be rotatable at the hinge end 362 about the locking pin 390. The drive handle 160 can be hingedly coupled (e.g., connected yet pivotable relative to in at least one plane) to the sleeve 340.

As shown in FIGS. 10A-10D, the adapter end 312 of the guide shaft 310 can comprise coupling (e.g., releasably coupling) features for the male threaded component adapter 320. The male threaded component adapter 320 can have a male threaded portion 322 and a guide shaft coupling portion 324. When the wrench 300 is engaged with the reducer coupling, such as the reducer coupling 20 of FIG. 1, the male threaded portion 322 can be configured to fit into the female threaded component 208 of the reducer coupling 20. In some embodiments, the male and female portions are reversed, such as the threaded portion 322 being female and the threaded component 208 being male.

Figure 10A:
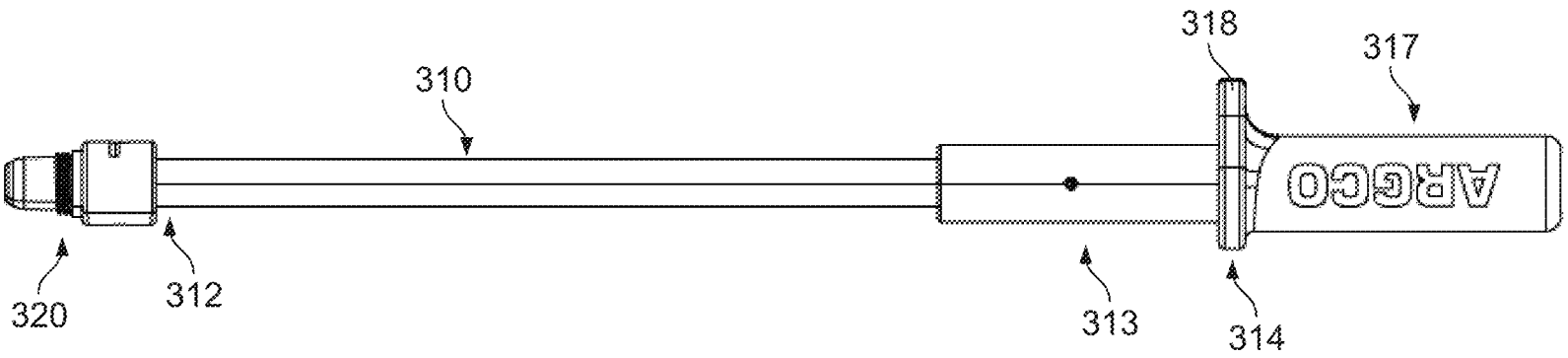
FIG. 10A illustrates a side view of a guide shaft subassembly of the drop nipple wrench assembly of FIG. 8A.
Figure 10B:
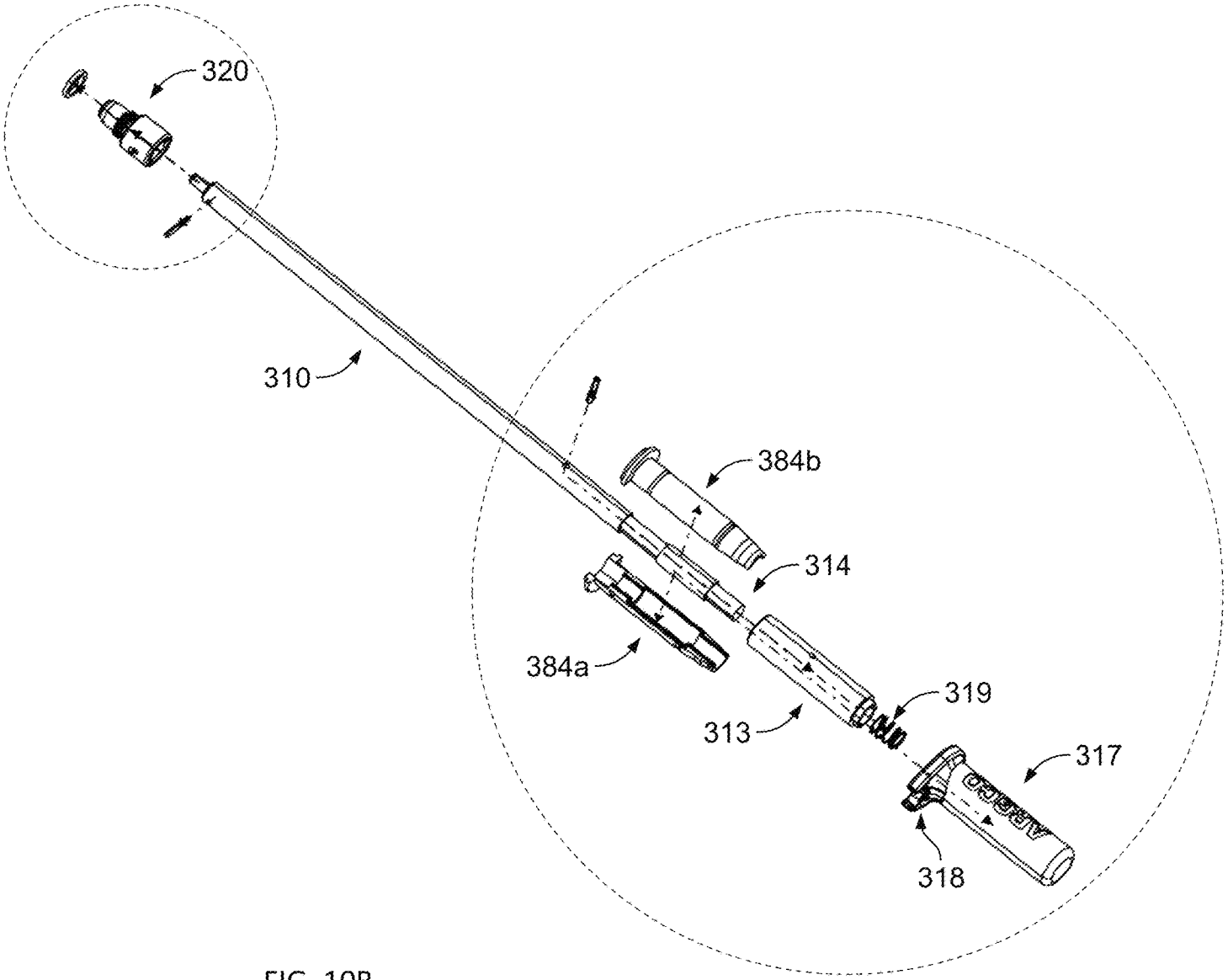
FIG. 10B illustrates an exploded view of the guide shaft subassembly of FIG. 10A.
Figure 10D:
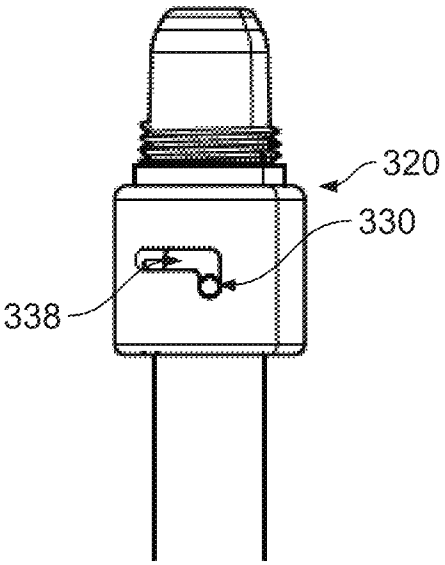
FIG. 10D illustrates a detailed assembled view of the adapter coupling portion of the guide shaft subassembly of FIG. 10A.
Figure 10C:
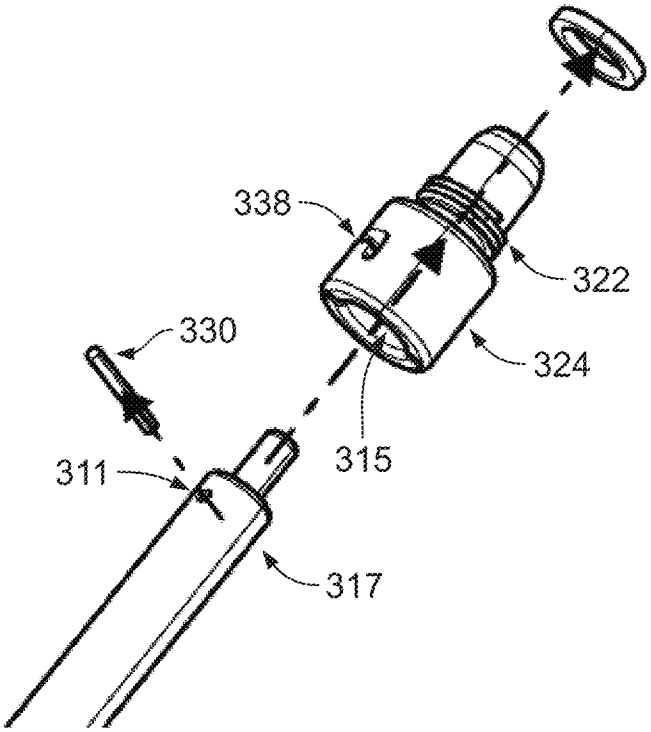
FIG. 10C illustrates a detailed exploded view of an adapter coupling portion of the guide shaft subassembly of FIG. 10B.

The guide shaft coupling portion 324 of the adapter 320 can be sized to engage with (e.g., slidably fit onto) the adapter end 312 of the guide shaft 310. The coupling portion 324 can include an opening 315 for slidably receiving the guide shaft 310. In some embodiments, such as shown in FIG. 10C, the adapter end 312 of the guide shaft 310 can include a portion with a reduced outer diameter configured to fit into smaller interior space within the male threaded portion 322. In some embodiments, the adapter end 312 can contact an interior end surface of the adapter 320.

In various embodiments, the coupling portion 324 can be removably connected to the guide shaft 310. The guide shaft coupling portion 324 of the adapter 320 can include a generally L-shaped slot 338. The adapter end 312 of the guide shaft 310 can include an opening 311 configured to receive a corresponding pin 330 (e.g., a dowel pin or otherwise) extending transversely to a longitudinal axis of the guide shaft 310. A portion of the pin 330 can extend radially outward from an outer wall of the guide shaft 310. To couple the adapter 320 to the guide shaft 310, the adapter 320 can be slid onto the guide shaft 310 until the opening 311 substantially aligns with a transverse side of the slot 338. The pin 330 can be inserted through the transverse side of the slot 338 into the opening 311. The adapter 320 can be rotated so that the longitudinal side of the slot 338 moves toward the pin 330. As will be described in greater detail below, the guide shaft 310 is spring-biased forward or away from the handle 317. As the pin 330 reaches the corner of the transverse and longitudinal side of the slot 338, the adapter 320 and the guide shaft 310 can be pushed forward by the biased spring 319 so that the pin 330 engages the longitudinal side of the slot 338. As the adapter 310 is inhibited from rotation by engagement of the pin 310 and the longitudinal side of the slot 338, the adapter 310 is locked to the guide shaft 310. In some embodiments, the pin 310 can engage the longitudinal side of the slot 338 with a sliding fit. In some variations, the pin 310 can have an outer dimension slightly greater than a width of the longitudinal side of the slot 338 so that a frictional force can aid in locking the pin 310 in the longitudinal side of the slot 338. The coupling of the adapter 310 and the guide shaft 310 can allow rotation of the handle 317 about its longitudinal axis be translated to rotation of the guide shaft 310 and the adapter 320. Rotating the handle 317 can allow engagement of the threaded portion 322 of the adapter 320 with a reducer coupling.

Figure 10E:
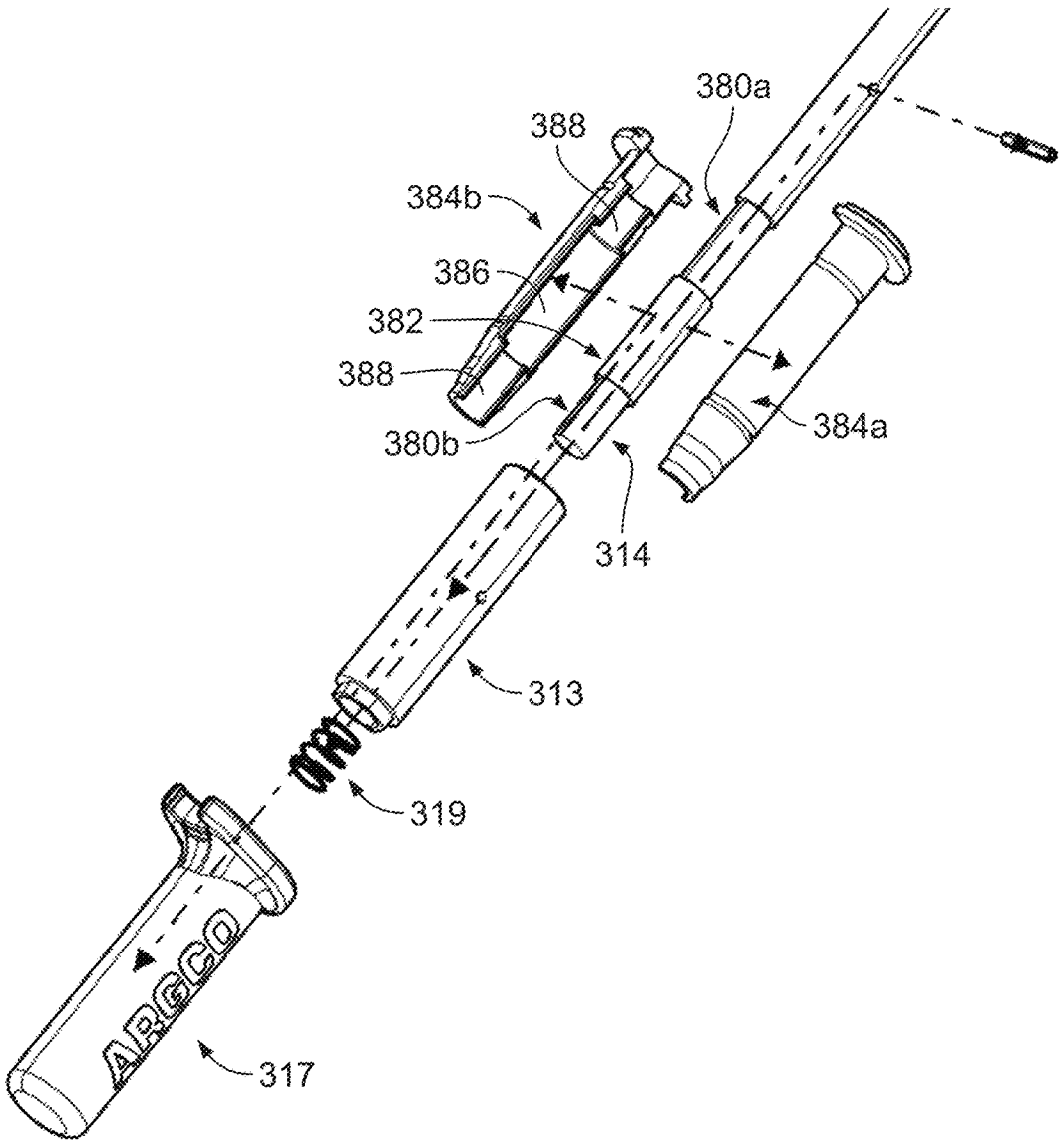
FIG. 10E illustrates a detailed exploded view of a handle portion of the guide shaft subassembly of FIG. 10B.
Figure 11A:
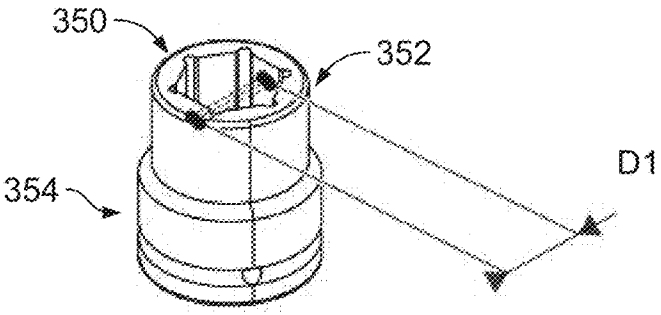
FIGS. 11A-11E illustrates examples of coupling sockets of various sizes.
Figure 11B:
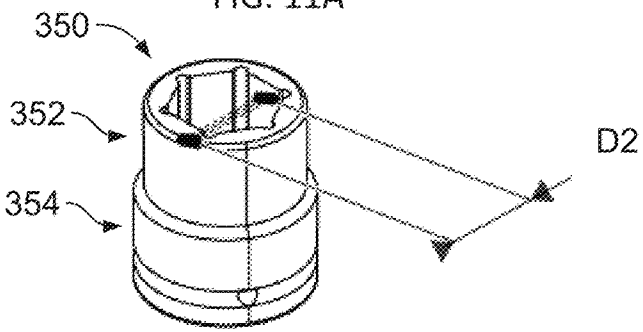
Figure 11C:
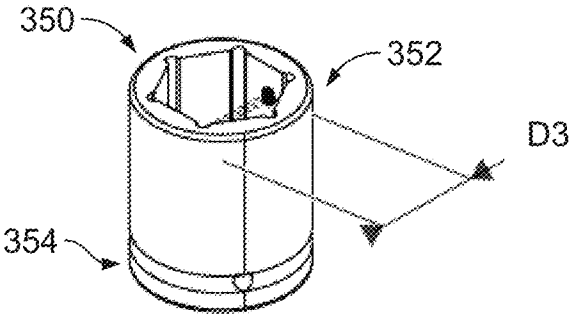
Figure 11D:
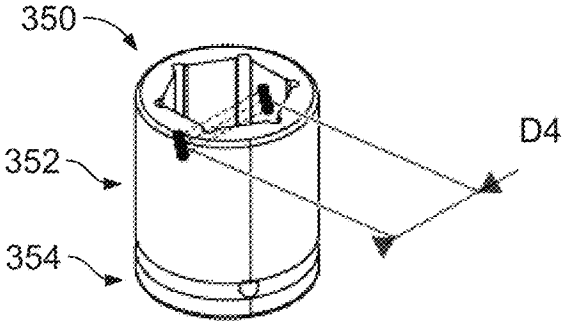
Figure 11E:
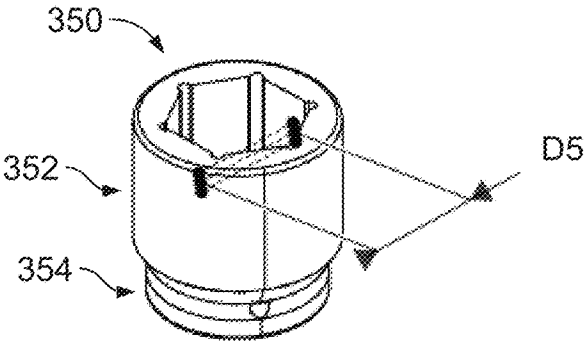

As shown in FIG. 10E, the handle end 314 of the guide shaft 310 can include two portions 380*a*, 380*b* of reduced outer dimension separated by an intermediate portion 382 of an outer dimension greater than the portions 380*a*, 380*b*. The portions 380*a*, 380*b*, 382 can be surrounded at least partially by a first intermediate sleeve 384*a* and a second intermediate sleeve 384*b*. The first and second intermediate sleeves 384*a*, 384*b* are configured to be between the guide shaft 310 and an inner wall of the handle 317 (see FIG. 12C). A spring 319 (such as compression spring) can be located around the portion 380*a* (see FIG. 12C). The first and second intermediate sleeves 384*a*, 384*b* can include an inner compartment 386 that has a greater inner dimension than the intermediate portion 382 and is longer than the intermediate portion 382. The inner compartment 386 can terminate at neck portions 388 of the intermediate sleeves 384*a*, 384*b*. The neck portions 388 can have an inner dimension smaller than the outer dimension of the intermediate portion 382 and greater than the outer dimension of the portion 380*a*. The handle end 314 of the guide shaft 310 can slide relative to the handle 317 and/or the first and second intermediate sleeve 384*a*, 384*b* as the inner compartment 386 is longer than the intermediate portion 382.

As described above, the spring 319 can be configured to bias the guide shaft 310 forward or away from the handle 317. The force of the spring 319 can facilitate in locking the adapter 320 to the guide shaft 310 by keeping the pin 330 engaged with the longitudinal side of the slot 338. As described above, the drive handle 360 can be locked into the stowed position by the engagement of the ridge 361 and the protrusion 318 of the handle 317. The biased spring 319 can apply a forward force on the ridge 361 against the protrusion 318 to facilitate locking of the drive handle 360 in the stowed position. In some embodiments, the drive handle 360 can be locked in the stowed position or storage configuration until the coupling socket 350 engages a reducer coupling. When the drive handle 360 is deployed (such as after the coupling socket 350 is moved forward toward the adapter 320 and/or has engaged a reducer coupling), the drive handle 360 can be unlocked from the handle 317 by applying a force (e.g., toward a free end of the handle 317) to overcome the force of the spring 319 (e.g., to slightly compress the spring 319) so that the ridge 361 can clear the protrusion 318 of the handle 317. The drive handle 360 can be rotated away from the longitudinal axis of the guide shaft 310 and/or the sleeve 340. The longitudinal axis of the drive handle 160 can be generally perpendicular to the longitudinal axis of the guide shaft 110 and/or sleeve 140 when the drive handle 360 is deployed.

Figure 12A:
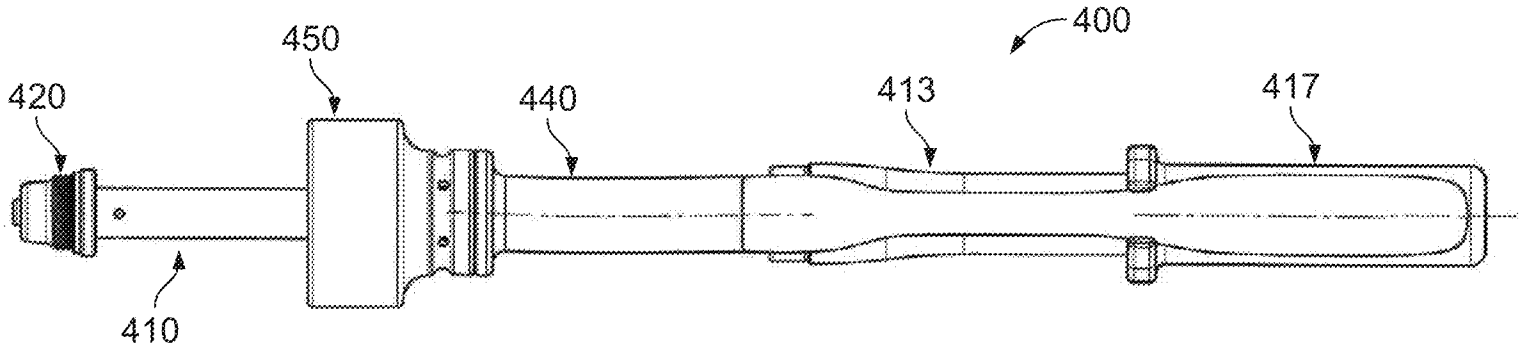
FIG. 12A illustrates a top view of another example drop nipple wrench assembly.
Figure 12B:
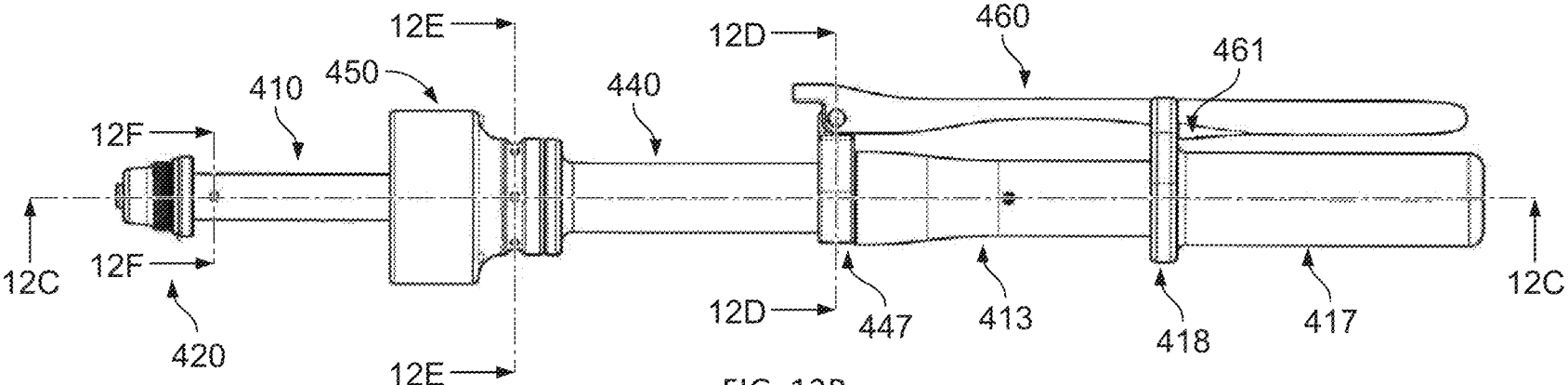
FIG. 12B illustrates a side view of the drop nipple wrench assembly of FIG. 12A.
Figure 12C:
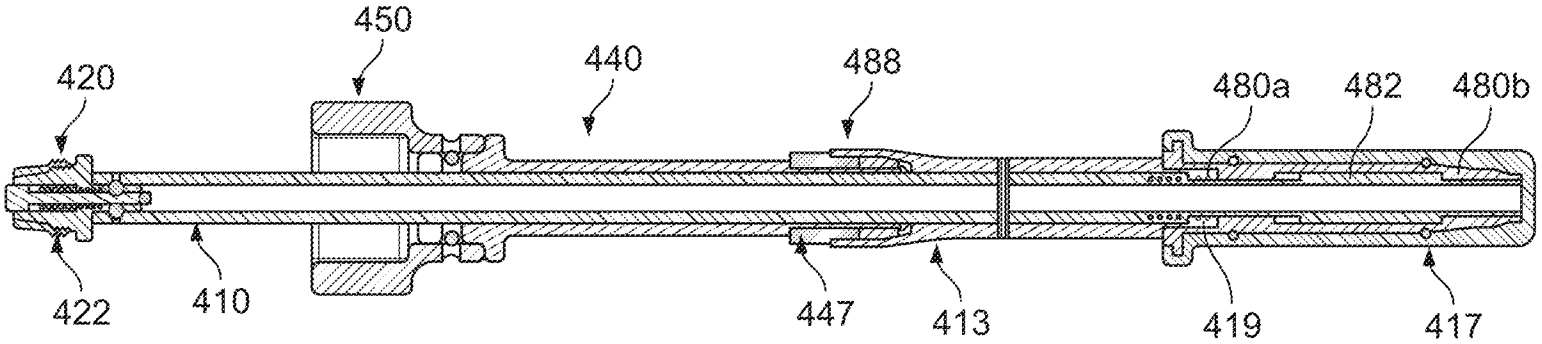
FIG. 12C illustrates a cross-sectional view of the drop nipple wrench assembly of FIG. 12B along the axis 12C-12C.
Figure 12D:
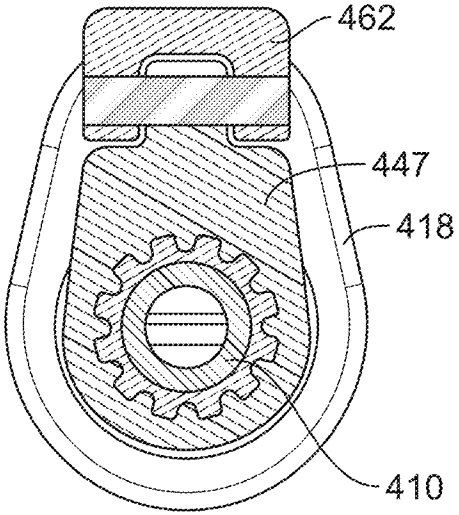
FIG. 12D illustrates a cross-sectional view of the drop nipple wrench assembly of FIG. 12B along the axis 12D-12D.
Figure 12E:
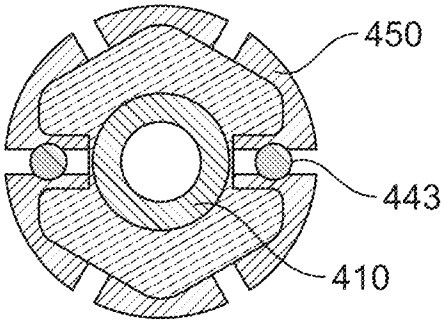
FIG. 12E illustrates a cross-sectional view of the drop nipple wrench assembly of FIG. 12B along the axis 12E-12E.
Figure 12F:
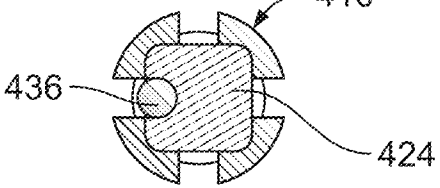
FIG. 12F illustrates a cross-sectional view of the drop nipple wrench assembly of FIG. 12B along the axis 12F-12F.
Figure 13B:
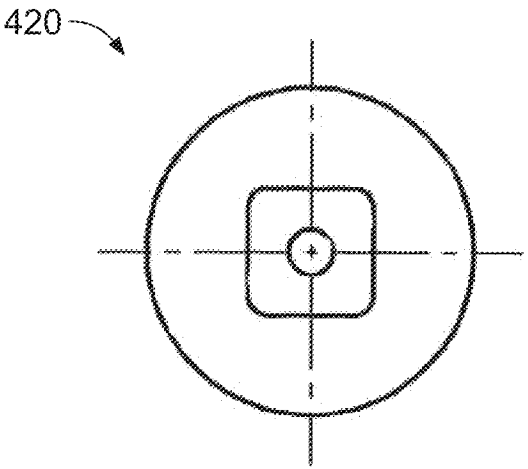
FIG. 13B illustrates a bottom view of the threaded component adapter of FIG. 13A.
Figure 13A:
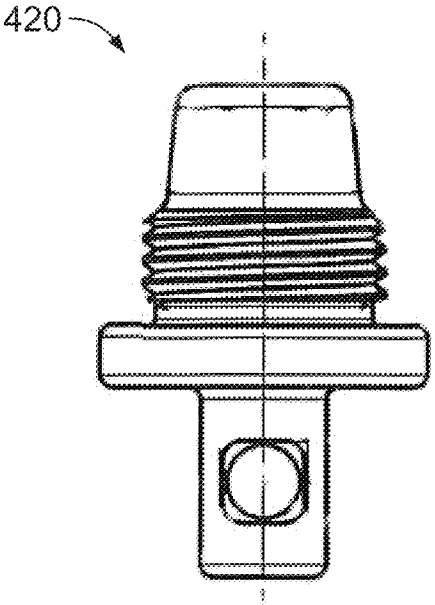
FIG. 13A illustrates an example threaded component adapter of the drop nipple wrench assembly of FIG. 12A.
Figure 13D:
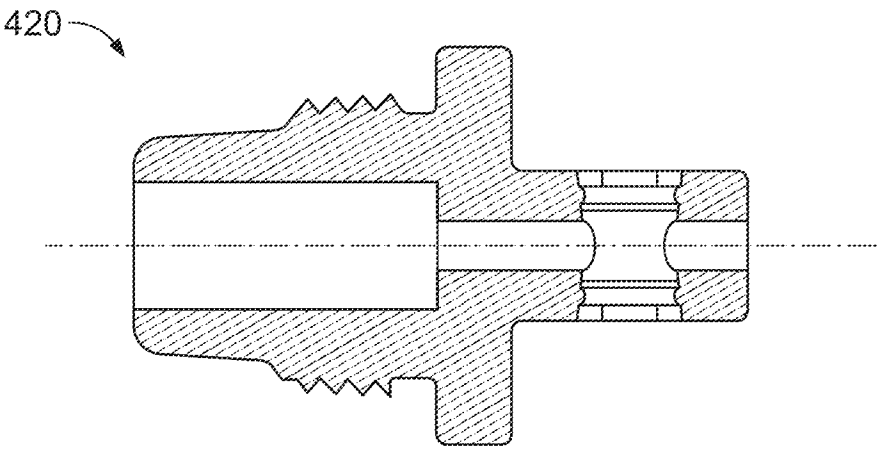
FIG. 13D illustrates a top view of the threaded component adapter of FIG. 13A.
Figure 13C:
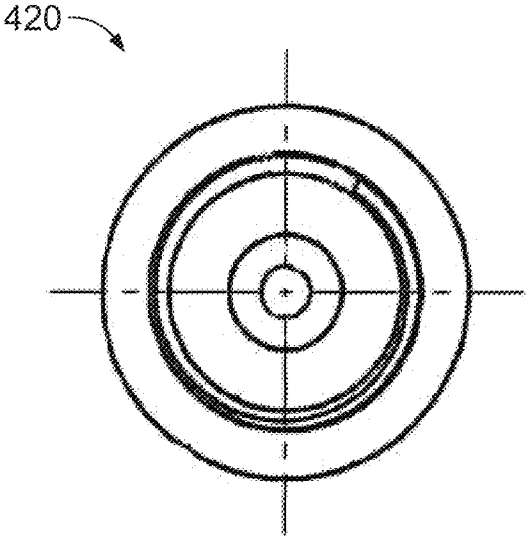
FIG. 13C illustrates a longitudinal cross-sectional view of the threaded component adapter of FIG. 13A.
Figure 14B:
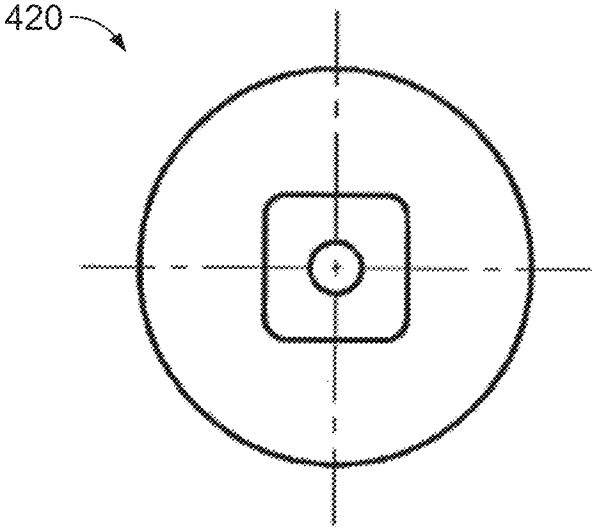
FIG. 14B illustrates a bottom view of the threaded component adapter of FIG. 14A.
Figure 14A:
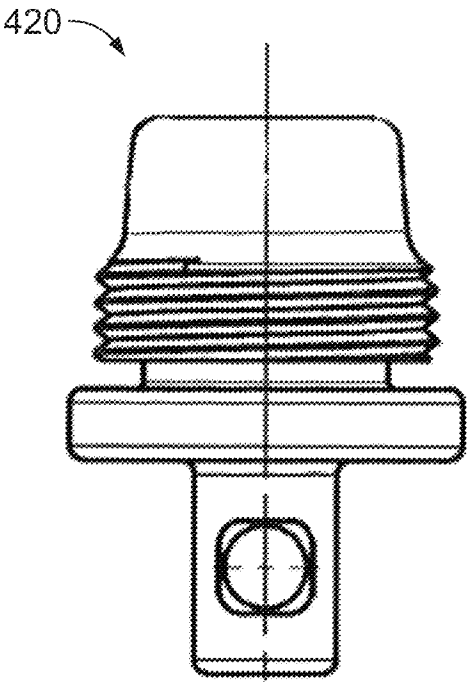
FIG. 14A illustrates another example threaded component adapter of the drop nipple wrench assembly of FIG. 12A.
Figure 14D:
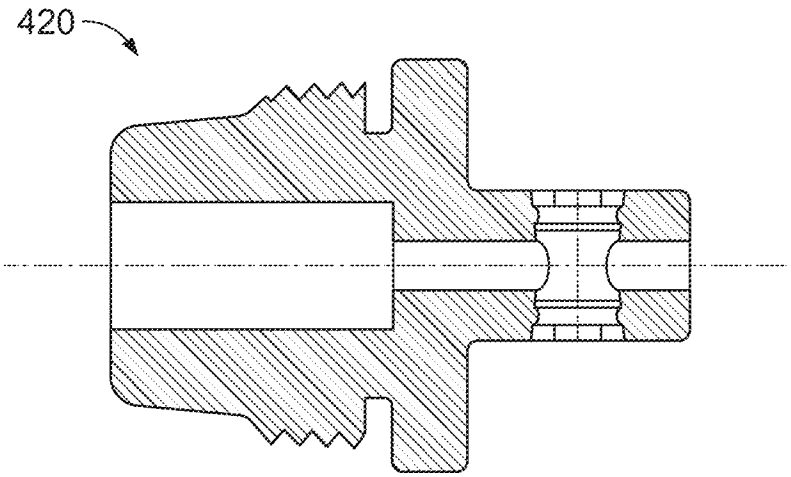
FIG. 14D illustrates a top view of the threaded component adapter of FIG. 14A.
Figure 14C:
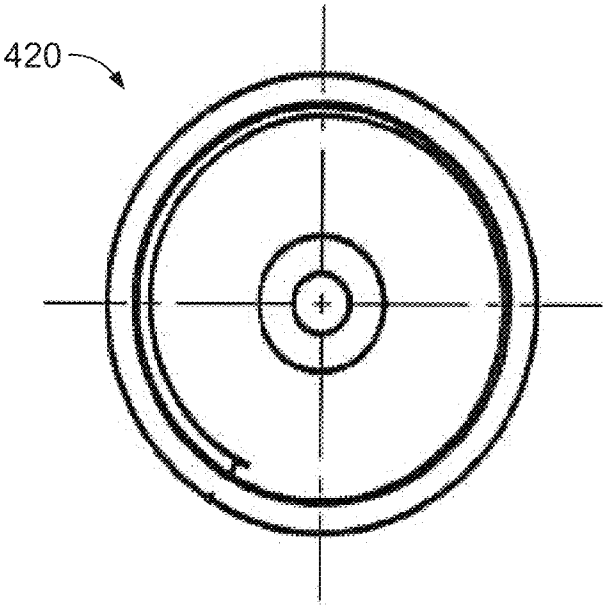
FIG. 14C illustrates a longitudinal cross-sectional view of the threaded component adapter of FIG. 14A.

FIGS. 12A-12C illustrate another embodiment of a drop nipple wrench assembly 400, and components thereof. The assembly 400 and components thereof can have any of features of the assembly 100, 300 and components thereof. Features of the assembly 400 can be incorporated into the assembly 100, 300 and features of the assembly 100, 300 can be incorporated into the assembly 400. For example, the adapter 420 can be coupled to the guide shaft 410 using substantially the same or similar mechanism as shown in the assembly 100 (see FIG. 12F); the coupling socket 450 can be coupled to the sleeve 440 using substantially the same or similar mechanism as shown in assembly 100 (see FIG. 12E); the drive handle 460 can be coupled to the sleeve 440 (see FIG. 12D) and/or engage the protrusion 418 of the handle 417 (see FIG. 12B) using substantially the same or similar mechanism as shown in assembly 300; the guide shaft 410 can be coupled to the handle 417 using substantially the same or similar mechanism as shown in the assembly 300 (see FIG. 12C).

As shown in FIGS. 12A-12C, the spacer tube 413 of the wrench assembly 400 can have an enlarged portion 488 with an inner space configured to receive (e.g., with an interference fit) a portion of the pivot ring 447. Engagement of the portion of the pivot ring 447 and the enlarged portion 488 of the spacer tube 413 can improve locking of the wrench assembly 400 in the undeployed configuration.

As shown in FIG. 12C, the male threaded portion 422 of the adapter 420 can include resilient or elastomeric (such as rubber or otherwise) threads. In some embodiments, an entire adapter 420 can be made of a resilient or elastomeric material. FIGS. 13A-13D and 14A-14D illustrates example adapters 420 including different thread sizes. For example, the threads can include ¾" (about 19.05 mm) National Pipe Threads (NPT), ½" (about 12.7 mm) NPT Threads, or threads of any other sizes. In some embodiments, such as shown in FIGS. 13A-13D and 14A-14D, the male threaded portion 422 of the adapter 420 can include a taper (e.g., comprising a tapered threaded portion 422 made of rubber or any other elastomeric material). In some embodiments, the taper can be about 1°, or about 1.2°, or about 1.5°, or about 1.8°, or about 2°, or any ranges between such values. The taper can help with centering the adapter 422 onto the reducer coupling. In some embodiments, such as shown in FIGS. 13A-13D and 14A-14D, the threaded portion 422 of the adapters 420 can include full threads and/or threads that start at a full height (e.g., are not tapered or reduced in height compared to full thread height). In some embodiments, the threaded portion 422 can include at least three (e.g., three, four, five, or more) full threads and/or full height threads. The full height threads can be less prone to damage than tapered threads and/or can be less prone to damage components that mate with the threads. In some embodiments, the adapter can include interchangeable male and female threads to accommodate different types of reducer couplings.

Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 15 degrees.

Conclusion

While a number of variations of the disclosure have been shown and described in detail, other modifications, which are within the scope of this disclosure, will be readily apparent to those of skill in the art based upon this disclosure. It is also contemplated that various combinations or sub-combinations of the specific features and aspects of the embodiments may be made and still fall within the scope of the disclosure. For example, although certain embodiments disclose some features as being male and some as being female, in certain embodiments such male and female features are reversed. Accordingly, it should be understood that various features and aspects of the disclosed embodiments can be combined with or substituted for one another in order to form varying modes of the disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings) may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination so disclosed.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Some embodiments have been described in connection with the accompanying drawings. The figures are drawn to scale where appropriate, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

Although this invention has been disclosed in the context of certain embodiments and examples, the scope of this disclosure extends beyond the specifically disclosed embodiments to other alternative embodiments and/or uses of the invention and obvious modifications and equivalents thereof. Any system, method, and device described in this application can include any combination of the preceding features described in this and other paragraphs, among other features and combinations described herein, including features and combinations described in subsequent paragraphs. While several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Various features and aspects of the disclosed embodiments can be combined with, or substituted for, one another in order to form varying modes of the disclosed invention. Thus, it is intended that the scope of the present invention herein disclosed should not be limited by the particular disclosed embodiments described above, but should be determined only by a fair reading of the claims that follow.

The following is claimed:

1. A drop nipple wrench assembly for removing a reducer coupling from a distribution pipe, the assembly comprising:

a guide shaft comprising a first end, a second end integrally formed with and coupled to a handle, and a longitudinal axis;

a sleeve slidably disposed over the guide shaft, the sleeve having a first end and a second end;

a drive handle comprising a ridge and rotatably coupled to the sleeve, wherein the sleeve comprises a hinge coupled to a hinged end of the drive handle so that a free end of the drive handle is configured to rotate away from or toward a longitudinal axis of the sleeve;

a coupling socket removably coupled to the sleeve at the first end of the sleeve, the coupling socket comprising a ratchet assembly;

a male screw adapter removably coupled to the guide shaft at the first end of the guide shaft; and an intermediate sleeve between a portion of the guide shaft within the handle and an inner wall of the handle, wherein the drop nipple wrench assembly has a storage configuration and a deployed configuration, wherein:

in the storage configuration, a longitudinal axis of the drive handle is generally parallel to a longitudinal axis of the guide shaft and/or sleeve, and the drive handle ridge is configured to interface with the handle to lock the drive handle, and in the deployed configuration, the longitudinal axis of the drive handle is generally perpendicular to the longitudinal axis of the guide shaft and/or sleeve.

2. The assembly of claim 1, wherein the intermediate sleeve comprises an inner compartment configured to allow the guide shaft to translate axially along the longitudinal axis of the guide shaft.

3. The assembly of claim 2, wherein the inner compartment encloses a spring disposed around a portion of the guide shaft enclosed within the inner compartment, the spring configured to bias the guide shaft away from a free end of the handle.

4. The assembly of claim 1, wherein the male screw adapter comprises a guide shaft coupling portion configured to be slidably received in a channel of the guide shaft at the first end of the guide shaft.

5. The assembly of claim 4, wherein the guide shaft coupling portion is configured to be removably locked in the channel with a ball detent arrangement.

6. The assembly of claim 1, wherein the male screw adapter comprises a generally L-shaped slot configured to receive a pin extending radially outward from the guide shaft.

7. The assembly of claim 6, wherein the pin engages a longitudinal side of the slot to lock the adapter to the guide shaft.

8. The assembly of claim 1, wherein the male screw adapter is made of an elastomeric material.

9. The assembly of claim 8, wherein the male screw adapter comprises a taper.

10. The assembly of claim 8, wherein the male screw adapter comprises full height threads.

11. The assembly of claim 10, wherein the male screw adapter comprises at least three revolutions of threads.

12. The assembly of claim 1, wherein the coupling socket is configured to be removably coupled to the sleeve with a ball detent arrangement.

13. The assembly of claim 1, wherein the coupling socket comprises a hex socket sleeve coupling portion, the first end of the sleeve comprising a corresponding hex head.

14. The assembly of claim 13, wherein the hex socket sleeve coupling portion is removably locked with the corresponding hex head using a spring-biased ball.

15. A method of removing a reducer coupling from a distribution pipe using a wrench assembly, the wrench assembly comprising a drive handle comprising a ridge configured to interface with the drive handle to lock the drive handle when the assembly is in a storage configuration, a sleeve coupled to a coupling socket comprising a ratcheting assembly configured to allow the coupling socket to move relative to the sleeve in a first rotational direction and to stop the coupling socket from moving relative to the sleeve in a second rotational direction, an adapter, and a guide shaft integrally formed with the drive handle and coupled to the adapter, the sleeve hingedly coupled to the drive handle and slidably receiving the guide shaft, and an intermediate sleeve between a portion of the guide shaft within the drive handle and an inner wall of the drive handle, the wrench assembly having an undeployed configuration in which a longitudinal axis of the drive handle is generally parallel to a longitudinal axis of the guide shaft and/or sleeve, the method comprising:

with the wrench assembly in the undeployed configuration, coupling a threaded portion of the adapter of the wrench assembly to a threaded portion of the reducer coupling;

moving the coupling socket toward the adapter until a hex socket of the coupling socket engages a hex head of the reducer coupling;

pivoting a free end of the drive handle away from the longitudinal axis of the guide shaft;

loosening the reducer coupling on the pipe, wherein loosening the reducer coupling on the pipe comprises:

rotating the drive handle in the first rotational direction about the longitudinal axis of the guide shaft, thereby rotating the coupling socket and the reducer coupling relative to the pipe;

rotating the drive handle in the second rotational direction, thereby not rotating the coupling socket;

rotating the drive handle in the first rotational direction, thereby rotating the coupling socket and the reducer coupling relative to the pipe; and removing the loosened reducer coupling from the distribution pipe.

16. The method of claim 15, wherein pivoting the drive handle further comprises unlocking the drive handle releasably locked onto a handle coupled to the guide shaft.

* * * * *